US010167534B2

(12) United States Patent
Fripp et al.

(10) Patent No.: US 10,167,534 B2
(45) Date of Patent: Jan. 1, 2019

(54) FRESH WATER DEGRADABLE DOWNHOLE TOOLS COMPRISING MAGNESIUM AND ALUMINUM ALLOYS

(71) Applicant: Halliburton Energy Services, Inc., Houston, TX (US)

(72) Inventors: Michael Linley Fripp, Carrollton, TX (US); Zachary William Walton, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 262 days.

(21) Appl. No.: 14/896,700

(22) PCT Filed: Aug. 13, 2015

(86) PCT No.: PCT/US2015/044985
§ 371 (c)(1),
(2) Date: Dec. 8, 2015

(87) PCT Pub. No.: WO2016/032758
PCT Pub. Date: Mar. 3, 2016

(65) Prior Publication Data

US 2016/0201435 A1 Jul. 14, 2016

Related U.S. Application Data

(63) Continuation of application No. PCT/US2014/053185, filed on Aug. 28, 2014.

(51) Int. Cl.
*C22C 21/02* (2006.01)
*C22C 21/08* (2006.01)
(Continued)

(52) U.S. Cl.
CPC ..... *C22C 21/02* (2013.01); *C22C 21/08* (2013.01); *C22C 21/10* (2013.01); *C22C 21/14* (2013.01);
(Continued)

(58) Field of Classification Search
CPC ..... C22C 21/02; C22C 21/08; C22C 21/10; C22C 21/14; C22C 21/18; C22C 23/00; C22C 23/02; C22C 21/16; E21B 33/12
See application file for complete search history.

(56) References Cited

U.S. PATENT DOCUMENTS 7,168,494 B2 1/2007 Starr et al.
8,211,248 B2 7/2012 Marya
(Continued)

FOREIGN PATENT DOCUMENTS

CN 104004950 A 8/2014
CN 104651691 A 5/2015
(Continued)

OTHER PUBLICATIONS

U.K. Examination Report from GB 1622301.8, dated Dec. 21, 2017, 5 pages.
(Continued)

*Primary Examiner* — Michael R Wills, III
(74) *Attorney, Agent, or Firm* — McGuireWoods LLP

(57) ABSTRACT

Downhole tools, methods, and systems of use thereof, the downhole tools comprising at least one component made of a doped alloy that at least partially degrades by micro-galvanic corrosion in the presence of fresh water having a salinity of less than about 1000 ppm, and wherein the doped alloy is selected from the group consisting of a doped magnesium alloy, a doped aluminum alloy, and any combination thereof.

14 Claims, 4 Drawing Sheets

(51) Int. Cl.

| | |
|---|---|
| ***C22C 21/10*** | (2006.01) |
| ***C22C 21/14*** | (2006.01) |
| ***E21B 33/12*** | (2006.01) |
| ***C22C 21/18*** | (2006.01) |
| ***C22C 23/00*** | (2006.01) |
| ***C22C 23/02*** | (2006.01) |
| ***C22C 21/16*** | (2006.01) |

(52) U.S. Cl.
CPC ..... *C22C 21/16* (2013.01); *C22C 21/18* (2013.01); *C22C 23/00* (2013.01); *C22C 23/02* (2013.01); *E21B 33/12* (2013.01)

(56) References Cited

U.S. PATENT DOCUMENTS

| | | | | |
|---|---|---|---|---|
| 8,425,651 | B2 | 4/2013 | Xu et al. | |
| 8,770,261 | B2 | 7/2014 | Marya | |
| 8,776,884 | B2 | 7/2014 | Xu et al. | |
| 8,789,610 | B2 * | 7/2014 | Oxford | B22F 1/02 166/242.8 |
| 8,905,147 | B2 | 12/2014 | Fripp et al. | |
| 2007/0181224 | A1 | 8/2007 | Marya et al. | |
| 2008/0149351 | A1 | 6/2008 | Marya et al. | |
| 2010/0161031 | A1 | 6/2010 | Papirov et al. | |
| 2011/0048743 | A1 | 3/2011 | Stafford et al. | |
| 2012/0318513 | A1 | 12/2012 | Mazyar et al. | |
| 2013/0022816 | A1 | 1/2013 | Smith et al. | |
| 2013/0048289 | A1 | 2/2013 | Mazyar et al. | |
| 2013/0048305 | A1 | 2/2013 | Xu et al. | |
| 2013/0133897 | A1 * | 5/2013 | Baihly | E21B 34/063 166/376 |
| 2013/0284425 | A1 | 10/2013 | Agrawal et al. | |
| 2014/0018489 | A1 | 1/2014 | Johnson | |
| 2014/0060834 | A1 * | 3/2014 | Quintero | E21B 33/13 166/292 |
| 2014/0124216 | A1 | 5/2014 | Fripp et al. | |
| 2014/0190705 | A1 | 7/2014 | Fripp et al. | |
| 2014/0196899 | A1 | 7/2014 | Jordan et al. | |
| 2015/0247376 | A1 * | 9/2015 | Tolman | E21B 33/12 166/297 |
| 2016/0024619 | A1 * | 1/2016 | Wilks | E21B 34/063 166/308.1 |

FOREIGN PATENT DOCUMENTS

| | | | |
|---|---|---|---|
| WO | 2009055354 | A2 | 4/2009 |
| WO | 2012091984 | A2 | 7/2012 |
| WO | WO-2013/070419 | | 5/2013 |
| WO | WO-2014/113058 | A2 | 7/2014 |
| WO | WO-2016/016628 | A2 | 2/2016 |
| WO | 2016032490 | A1 | 3/2016 |
| WO | 2016032619 | A1 | 3/2016 |
| WO | 2016032758 | A1 | 3/2016 |
| WO | 2016036371 | A1 | 3/2016 |

OTHER PUBLICATIONS

U.K. Examination Report from GB 1621848.9, dated Dec. 21, 2017, 5 pages.
U.K. Examination Report from GB 1622173.1, dated Dec. 21, 2017, 5 pages.
Australian Examination Report from Australian Patent Application No. 2015307092, dated Feb. 1, 2018, 3 pages.
Belov et al., Iron in Aluminum Alloys: Impurity and Alloying Element, CRC Press, Feb. 7, 2002, pp. 179-181.
State Water Resources Control Board Division of Water Quality GAMA Program, Groundwater Information Sheet: Salinity.
Winslow et al., Saline-Water Resources of Texas, Geological Survey Water-Supply Paper 1365, Department of the Interior, 1956.
International Search Report and Written Opinion for PCT/US2015/044985 dated Oct. 22, 2015.

* cited by examiner

FRESH WATER DEGRADABLE DOWNHOLE TOOLS COMPRISING MAGNESIUM AND ALUMINUM ALLOYS

CROSS-REFERENCE TO RELATED APPLICATIONS

This application claims priority to PCT/US2014/053185 filed on Aug. 28, 2014 and entitled "Degradable Downhole Tools Comprising Magnesium Alloys."

BACKGROUND

The present disclosure relates to downhole tools used in the oil and gas industry and, more particularly, to degradable downhole tools comprising a doped alloy that at least partially degrades in the presence of fresh water having a salinity of less than about 1000 parts per million (ppm).

In the oil and gas industry, a wide variety of downhole tools are used within a wellbore in connection with producing hydrocarbons or reworking a well that extends into a hydrocarbon producing subterranean formation. For examples, some downhole tools, such as fracturing plugs (i.e., "frac" plugs), bridge plugs, and packers, may be used to seal a component against casing along a wellbore wall or to isolate one pressure zone of the formation from another.

After the production or reworking operation is complete, the downhole tool must be removed from the wellbore, such as to allow for production or further operations to proceed without being hindered by the presence of the downhole tool. Removal of the downhole tool(s) is traditionally accomplished by complex retrieval operations involving milling or drilling the downhole tool for mechanical retrieval. In order to facilitate such operations, downhole tools have traditionally been composed of drillable metal materials, such as cast iron, brass, or aluminum. These operations can be costly and time consuming, as they involve introducing a tool string (e.g., a mechanical connection to the surface) into the wellbore, milling or drilling out the downhole tool (e.g., breaking a seal), and mechanically retrieving the downhole tool or pieces thereof from the wellbore to bring to the surface.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
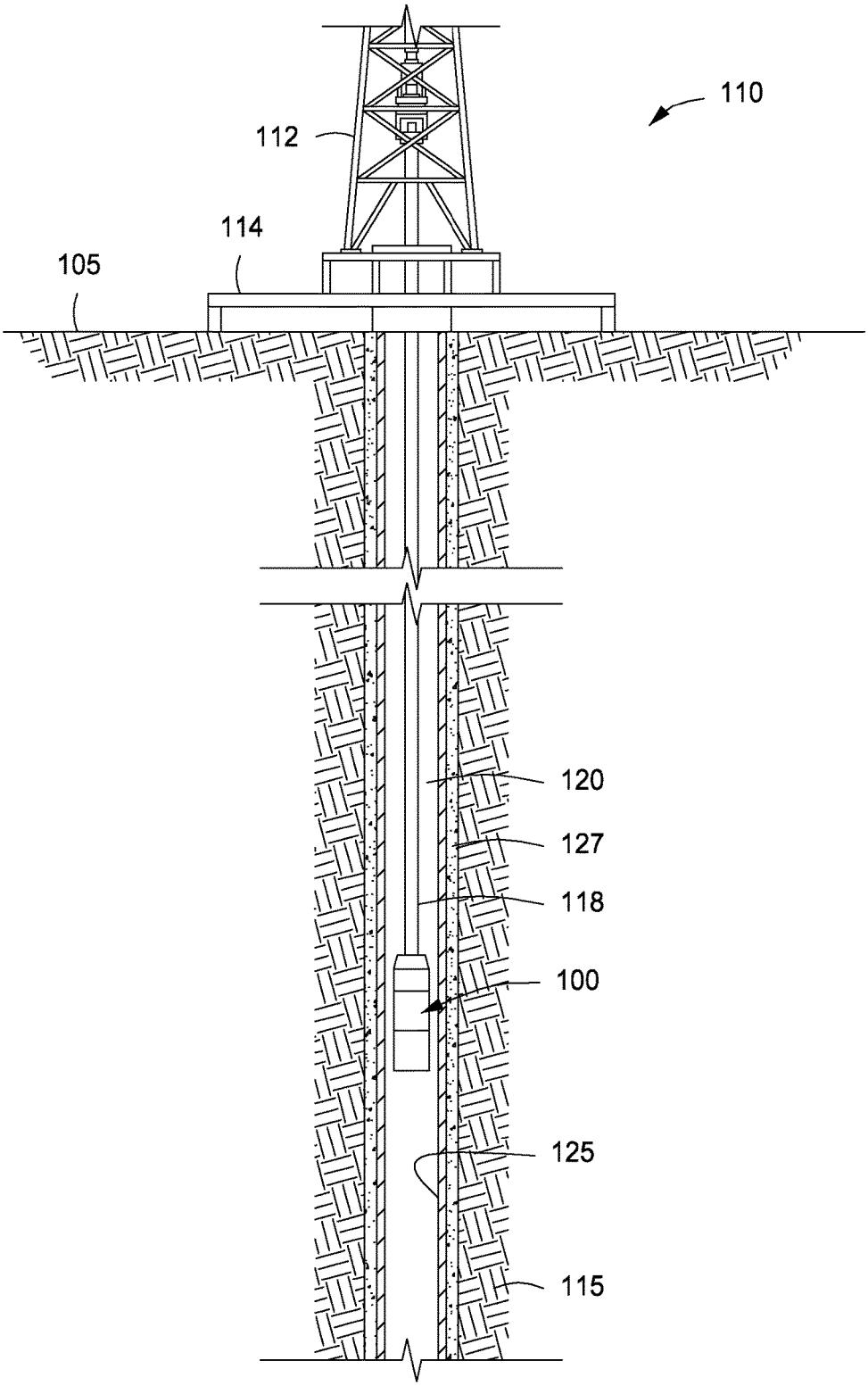
FIG. 1 is a well system that can employ one or more principles of the present disclosure, according to one or more embodiments.

The present disclosure relates to downhole tools used in the oil and gas industry and, more particularly, to degradable downhole tools comprising a doped alloy that at least partially degrades in the presence of fresh water having a salinity of less than about 1000 ppm.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−5% of each numerical value. For example, if the numerical value is "about 80%," then it can be 80%+/−5%, equivalent to 76% to 84%. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like, are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The downhole tools described herein include one or more components comprised of a doped alloys in a solid solution capable of degradation at least partially by galvanic corrosion in the presence of fresh water having a salinity of less than about 1000 ppm, where the presence of the dopant accelerates the corrosion rate compared to a similar alloy without a dopant. Indeed, degradation in fresh water as described herein may be enhanced by including the dopant in an alloy alone, and may further be increased by increasing the concentration of dopant therein. As used herein the term "degrading at least partially" or "partially degrades" refers to the tool or component degrading at least to the point wherein about 20% or more of the mass of the tool or component degrades.

As used herein, the term "fresh water" refers to water having a salinity of less than about 1000 ppm. The downhole tools of the present disclosure may include multiple structural components that may each be composed of the doped alloys described herein. For example, in one embodiment, a downhole tool may comprise at least two components, each made of the same doped alloy or each made of different doped alloys. In other embodiments, the downhole tool may comprise more than two components that may each be made of the same or different doped alloys. Moreover, it is not necessary that each component of a downhole tool be composed of a doped alloy, provided that the downhole tool is capable of sufficient degradation for use in a particular downhole operation. Accordingly, one or more components of the downhole tool may have different degradation rates based on the type of doped alloy selected.

As used herein, the term "degradable" and all of its grammatical variants (e.g., "degrade," "degradation," "degrading," and the like) refer to the dissolution, galvanic conversion, or chemical conversion of solid materials such that a reduced structural integrity results. In complete degradation, structural shape is lost. The doped alloy solid solutions described herein may degrade by galvanic corrosion in the presence of fresh water. The term "galvanic corrosion" refers to corrosion occurring when two different metals or metal alloys are in electrical connectivity with each other and both are in contact with an electrolyte. The term "galvanic corrosion" includes microgalvanic corrosion. The electrolyte herein is fresh water as previously defined. As used herein, the term "electrical connectivity" means that the two different metals or metal alloys are either touching or in close proximity to each other such that when contacted with an electrolyte, the electrolyte becomes electrically conductive and ion migration occurs between one of the metals and the other metal.

In some instances, the degradation of the doped alloy may be sufficient for the mechanical properties of the material to be reduced to a point that the material no longer maintains its integrity and, in essence, falls apart or sloughs off. The conditions for degradation are generally wellbore conditions in a wellbore environment where an external stimulus may be used to initiate or affect the rate of degradation. For example, fresh water may be introduced into a wellbore to initiate degradation or may be used to perform another operation (e.g., hydraulic fracturing) such that the fresh water initiates degradation in addition to performing the operation. In another example, the wellbore may naturally produce the electrolyte sufficient to initiate degradation. The term "wellbore environment" refers to a subterranean location within a wellbore, and includes both naturally occurring wellbore environments and materials or fluids introduced into the wellbore environment. Degradation of the degradable materials identified herein may be anywhere from about 4 hours (hrs) to about 576 hrs (or about 4 hours to about 24 days) from first contact with fresh water in a wellbore environment, encompassing any value and subset therebetween. Each of these values is critical to the embodiments of the present disclosure and may depend on a number of factors including, but not limited to, the alloy selected, the dopant selected, the amount of dopant selected, and the like. In some embodiments, the degradation rate of the doped alloys described herein may be accelerated based on conditions in the wellbore or conditions of the wellbore fluids (either natural or introduced) including temperature, pH, salinity, pressure, and the like.

In some embodiments, the electrolyte capable of degrading the doped alloys described herein may be fresh water having a salinity of less than about 1000 ppm. For example, in some embodiments, the salinity of the fresh water is in the range of about 10 ppm to about 1000 ppm, encompassing any value and subset therebetween. For instance, the salinity may be about 10 ppm to about 100 ppm, or about 100 ppm to about 200 ppm, or about 200 ppm to about 400 ppm, or about 400 ppm to about 600 ppm, or about 600 ppm to about 800 ppm, or about 800 ppm to about 1000 ppm, encompassing any value and subset therebetween. Each of these values is critical to the embodiments of the present disclosure and may depend on a number of factors including, but not limited to, the desired degradation rate, the availability of water having a particular ppm, the type of ion or salt within the fresh water, and the like.

The salinity of the fresh water depends on the presence of ions or salts capable of providing such ions. In some embodiments, the salinity may be due to the presence of a halide anion (i.e., fluoride, chloride, bromide, iodide, and astatide), a halide salt, an oxoanion (including monomeric oxoanions and polyoxoanions), and any combination thereof. Suitable examples of halide salts for use as the electrolytes of the present disclosure may include, but are not limited to, a potassium fluoride, a potassium chloride, a potassium bromide, a potassium iodide, a sodium chloride, a sodium bromide, a sodium iodide, a sodium fluoride, a calcium fluoride, a calcium chloride, a calcium bromide, a calcium iodide, a zinc fluoride, a zinc chloride, a zinc bromide, a zinc iodide, an ammonium fluoride, an ammonium chloride, an ammonium bromide, an ammonium iodide, a magnesium chloride, potassium carbonate, potassium nitrate, sodium nitrate, and any combination thereof. The oxyanions for use as the electrolyte of the present disclosure may be generally represented by the formula $A_xO_y^{z-}$, where A represents a chemical element and O is an oxygen atom; x, y, and z are integers between the range of about 1 to about 30, and may be or may not be the same integer. Examples of suitable oxoanions may include, but are not limited to, carbonate, borate, nitrate, phosphate, sulfate, nitrite, chlorite, hypochlorite, phosphite, sulfite, hypophosphite, hyposulfite, triphosphate, and any combination thereof.

In certain embodiments, the salinity of the fresh water described herein is due to the presence of ions selected from the group consisting of chloride, sodium, nitrate, calcium, potassium, magnesium, bicarbonate, sulfate, and any combination thereof.

Referring now to FIG. 1, illustrated is an exemplary well system 110 for a downhole tool 100. As depicted, a derrick 112 with a rig floor 114 is positioned on the earth's surface 105. A wellbore 120 is positioned below the derrick 112 and the rig floor 114 and extends into subterranean formation 115. As shown, the wellbore may be lined with casing 125 that is cemented into place with cement 127. It will be appreciated that although FIG. 1 depicts the wellbore 120 having a casing 125 being cemented into place with cement 127, the wellbore 120 may be wholly or partially cased and wholly or partially cemented (i.e., the casing wholly or partially spans the wellbore and may or may not be wholly or partially cemented in place), without departing from the scope of the present disclosure. Moreover, the wellbore 120 may be an open-hole wellbore. A tool string 118 extends from the derrick 112 and the rig floor 114 downwardly into the wellbore 120. The tool string 118 may be any mechanical connection to the surface, such as, for example, wireline, slickline, jointed pipe, or coiled tubing. As depicted, the tool string 118 suspends the downhole tool 100 for placement into the wellbore 120 at a desired location to perform a specific downhole operation. Examples of such downhole operations may include, but are not limited to, a stimulation operation, an acidizing operation, an acid-fracturing operation, a sand control operation, a fracturing operation, a frac-packing operation, a remedial operation, a perforating operation, a near-wellbore consolidation operation, a drilling operation, a completion operation, and any combination thereof.

In some embodiments, the downhole tool 100 may comprise one or more components, one or all of which may be composed of a degradable doped alloy (i.e., all or at least a portion of the downhole tool 100 may be composed of a doped alloy described herein). In some embodiments, the downhole tool 100 may be any type of wellbore isolation device capable of fluidly sealing two sections of the wellbore 120 from one another and maintaining differential pressure (i.e., to isolate one pressure zone from another). The wellbore isolation device may be used in direct contact with the formation face of the wellbore, with casing string, with a screen or wire mesh, and the like. Examples of suitable wellbore isolation devices may include, but are not limited to, a frac plug, a frac ball, a setting ball, a bridge plug, a wellbore packer, a wiper plug, a cement plug, a basepipe plug, a sand screen plug, an inflow control device (ICD) plug, an autonomous ICD plug, a tubing section, a tubing string, and any combination thereof. In some embodiments, the downhole tool 100 may be a wellbore isolation device, a perforation tool, a cementing tool, or a completion tool. The downhole tool 100 may, in other embodiments, be a drill tool, a testing tool, a slickline tool, a wireline tool, an autonomous tool, a tubing conveyed perforating tool, and any combination thereof. The downhole tool 100 may have one or more components made of the doped alloy including, but not limited to, the mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block (e.g., to prevent sliding sleeves from translating), a logging tool, a housing, a release mechanism, a pumpdown tool, an inflow control device plug, an autonomous inflow control device plug, a coupling, a connector, a support, an enclosure, a cage, a slip body, a tapered shoe, or any other downhole tool or component thereof.

The doped alloys for use in forming a first or second (or additional) component of the downhole tool 100 may be in the form of a solid solution. As used herein, the term "solid solution" refers to an alloy that is formed from a single melt where all of the components in the alloy (e.g., a magnesium alloy and/or aluminum alloy) are melted together in a casting. The casting can be subsequently extruded, wrought, hipped, or worked. Preferably, the primary alloy material (e.g., magnesium or aluminum) and the at least one other ingredient (e.g., dopant, rare earth metals, or other materials, as discussed below) are uniformly distributed throughout the doped alloy, although granular inclusions may also be present, without departing from the scope of the present disclosure. As used herein, the term "granular inclusions" (or simply "inclusions") encompasses both intra-inclusions and inter-granular inclusions. As used herein, the term "primary alloy material" (or "primary alloy"), and grammatical variants thereof, refers to the metal most abundant (>50%) in an alloy (e.g., a doped alloy). It is to be understood that some minor variations in the distribution of particles of the primary alloy and the at least one other ingredient can occur, but that it is preferred that the distribution is such that a solid solution of the metal alloy occurs. In some embodiments, the primary alloy and at least one other ingredient in the doped alloys described herein are in a solid solution, wherein the addition of a dopant results in granular inclusions being formed.

The dopant is in solution with the alloy to form the doped alloys of the present disclosure. During fabrication, the dopant may be added as part of a master alloy. For example, the dopant may be added to one of the alloying elements prior to mixing all of the other alloys and the primary alloy. For example, during the fabrication of an AZ alloy, discussed in detail below, the dopant (e.g., iron) may be dissolved in aluminum, followed by mixing with the remaining alloy, magnesium (the primary alloy), and other components if present. Additional amounts of the aluminum may be added after dissolving the dopant, as well, without departing from the scope of the present disclosure, in order to achieve the desired composition.

Suitable dopants for use in forming the doped alloys described herein may include, but are not limited to, iron, copper, nickel, mercury, tin, chromium, cobalt, calcium, carbon, lithium, silicon, silver, gold, palladium, gallium, and any combination thereof. In some embodiments, preferred dopants include copper, iron, nickel, mercury, gallium, and any combination thereof. The dopant may be included with the doped alloys described herein in an amount of from about 0.05% to about 15% by weight of the doped alloy, encompassing every value and subset therebetween. For example, the dopant may be present in an amount of from about 0.05% to about 3%, or about 3% to about 6%, or about 6% to about 9%, or about 9% to about 12%, or about 12% to about 15% by weight of the doped alloy, encompassing every value and subset therebetween. Other examples include a dopant in an amount of from about 1% to about 10% by weight of the doped alloy, encompassing every value and subset therebetween. Each of these values is critical to the embodiments of the present disclosure and may depend on a number of factors including, but not limited to, the type of magnesium and/or aluminum alloy selected, the desired rate of degradation, the wellbore environment, and the like, and any combination thereof.

The doped alloys described herein may further comprise an amount of material, termed "supplementary material," that is defined as neither the primary alloy, other specific alloying materials forming the doped alloy, or the dopant. This supplementary material may include, but is not limited to, unknown materials, impurities, additives (e.g., those purposefully included to aid in mechanical properties), and any combination thereof. The supplementary material minimally, if at all, effects the acceleration of the corrosion rate of the doped alloy. Accordingly, the supplementary material may, for example, inhibit the corrosion rate or have no affect thereon. As defined herein, the term "minimally" with reference to the effect of the acceleration rate refers to an effect of no more than about 5% as compared to no supplementary material being present. This supplementary material, as discussed in greater detail below, may enter the doped alloys of the present disclosure due to natural carry-over from raw materials, oxidation of the alloys or other elements, manufacturing processes (e.g., smelting processes, casting processes, alloying process, and the like), or the like, and any combination thereof. Alternatively, the supplementary material may be intentionally included additives placed in the doped alloy to impart a beneficial quality to the alloy, as discussed below. Generally, the supplemental material is present in the doped alloys described herein in an amount of less than about 10% by weight of the doped magnesium alloy, including no supplemental material at all (i.e., 0%).

In some embodiments, the density of the component of the downhole tool 100 composed of a doped alloy, as described herein, may exhibit a density that is relatively low. The low density may prove advantageous in ensuring that the downhole tool 100 may be placed in extended-reach wellbores, such as extended-reach lateral wellbores. As will be appreciated, the more components of the downhole tool 100 composed of a doped alloy having a low density, the lesser the density of the downhole tool 100 as a whole. In some embodiments, the doped alloy is a magnesium alloy or an aluminum alloy, as described below, and may have a density of less than about 5 g/cm$^3$, or less about than 4 g/cm$^3$, or less than about 3 g/cm$^3$ or less about than 2 g/cm$^3$, or less than about 1 g/cm$^3$. For example, in some embodiments, the doped alloy comprises one or more alloy elements that are lighter than steel, the density of the may be less than about 5 g/cm$^3$. By way of example, the inclusion of lithium in a magnesium alloy can reduce the density of the alloy.

In some embodiments, the doped alloy forming at least one of the first components or second components (or any additional components) of a downhole tool 100 may be one of a doped magnesium alloy, a doped aluminum alloy, and any combination thereof.

With reference to the doped magnesium alloys for use in forming a portion of the downhole tool 100, the magnesium in the doped magnesium alloy is present at a concentration in the range of from about 60% to about 99.95% by weight of the doped magnesium alloy, encompassing any value and subset therebetween. For example, in some embodiments, the magnesium concentration may be in the range of about 60% to about 99.95%, 70% to about 98%, and preferably about 80% to about 95% by weight of the doped magnesium alloy, encompassing any value and subset therebetween. Each of these values is critical to the embodiments of the present disclosure and may depend on a number of factors including, but not limited to, the type of magnesium alloy, the desired degradability of the magnesium alloy, and the like.

Magnesium alloys comprise at least one other ingredient besides the magnesium. The other ingredients can be selected from one or more metals, one or more non-metals, or a combination thereof. Suitable metals that may be alloyed with magnesium include, but are not limited to, lithium, sodium, potassium, rubidium, cesium, beryllium, calcium, strontium, barium, aluminum, gallium, indium, tin, thallium, lead, bismuth, scandium, titanium, vanadium, chromium, manganese, iron, cobalt, nickel, copper, zinc, yttrium, zirconium, niobium, molybdenum, ruthenium, rhodium, palladium, praseodymium, silver, lanthanum, hafnium, tantalum, tungsten, terbium, rhenium, osmium, iridium, platinum, gold, neodymium, gadolinium, erbium, oxides of any of the foregoing, and any combinations thereof.

Suitable non-metals that may be alloyed with magnesium include, but are not limited to, graphite, carbon, silicon, boron nitride, and combinations thereof. The carbon can be in the form of carbon particles, fibers, nanotubes, fullerenes, and any combination thereof. The graphite can be in the form of particles, fibers, graphene, and any combination thereof. The magnesium and its alloyed ingredient(s) may be in a solid solution and not in a partial solution or a compound where inter-granular inclusions may be present. In some embodiments, the magnesium and its alloyed ingredient(s) may be uniformly distributed throughout the magnesium alloy but, as will be appreciated, some minor variations in the distribution of particles of the magnesium and its alloyed ingredient(s) can occur. In other embodiments, the magnesium alloy is a sintered construction and/or a forged construction.

As described above, the doped magnesium alloys of the present disclosure comprise a dopant. The dopant may be any of the aforementioned dopants in the range of about 0.05% to about 15% by weight of the doped magnesium alloy, or of from about 1% to about 10% by weight of the doped magnesium alloy, encompassing any value and subset therebetween. As specific examples, the doped magnesium alloy may comprise a nickel dopant in the range of about 0.1% to about 6% (e.g., about 0.1%, about 0.5%, about 1%, about 2%, about 3%, about 4%, about 5%, about 6%) by weight of the doped magnesium alloy, encompassing any value and subset therebetween; the doped magnesium alloy may comprise a copper dopant in the range of about 6% to about 12% (e.g., about 6%, about 7%, about 8%, about 9%, about 10%, about 11%, about 12%) by weight of the doped magnesium alloy, encompassing any value and subset therebetween; and/or the doped magnesium alloy may comprise an iron dopant in the range of about 2% to about 6% (e.g., about 2%, about 3%, about 4%, about 5%, about 6%) by weight of the doped magnesium alloy, encompassing any value and subset therebetween. As described above, each of these values is critical to the embodiments of the present disclosure to at least affect the degradation rate of the doped magnesium alloy.

Examples of specific doped magnesium alloys for use in the embodiments of the present disclosure may include, but are not limited to, a doped MG magnesium alloy, a doped WE magnesium alloy, a doped AZ magnesium alloy, a doped AM magnesium alloy, or a doped ZK magnesium alloy. As defined herein, a "doped MG magnesium alloy" is an alloy comprising at least magnesium, dopant, and optional supplemental material, as defined herein; a "doped WE magnesium alloy" is an alloy comprising at least a rare earth metal, magnesium, dopant, and optional supplemental material, as defined herein; a "doped AZ magnesium alloy" is an alloy comprising at least aluminum, zinc, magnesium, dopant, and optional supplemental material, as defined herein; a "doped AM magnesium" is an alloy comprising at least aluminum, manganese, magnesium, dopant, and optional supplemental material, as defined herein; and a "ZK magnesium alloy" is an alloy comprising at least zinc, zirconium, magnesium, dopant, and optional supplemental material, as defined herein.

Accordingly, any or all of the doped MG magnesium alloy, the doped WE magnesium alloy, the doped AZ magnesium alloy, the doped AM magnesium alloy, and/or the doped ZK magnesium alloy may comprise a supplemental material, or may have no supplemental material, without departing from the scope of the present disclosure. The specific doped magnesium alloys are discussed in greater detail below.

With reference to the doped aluminum alloys for use in forming a portion of the downhole tool 100, the aluminum in the doped aluminum alloy is present at a concentration in the range of from about 45% to about 99% by weight of the doped aluminum alloy, encompassing any value and subset therebetween. For example, suitable magnesium alloys may have aluminum concentrations of about 45% to about 50%, or about 50% to about 60%, about 60% to about 70%, or about 70% to about 80%, or about 80% to about 90%, or about 90% to about 99% by weight of the doped aluminum alloy, encompassing any value and subset therebetween. Each of these values is critical to the embodiments of the present disclosure and may depend on a number of factors including, but not limited to, the type of aluminum alloy, the desired degradability of the aluminum alloy, and the like.

The doped aluminum alloys may be wrought or cast aluminum alloys and comprise at least one other ingredient besides the aluminum. The other ingredients can be selected from one or more any of the metals, non-metals, and combinations thereof described above with reference to doped magnesium alloys, with the addition of the doped aluminum alloys additionally being able to comprise magnesium.

As described above, the doped aluminum alloys of the present disclosure comprise a dopant. The dopant may be any of the aforementioned dopants in the range of about 0.05% to about 15% by weight of the doped aluminum alloy, or of from about 1% to about 10% by weight of the doped aluminum alloy, encompassing any value and subset therebetween. As specific examples, the doped aluminum alloy may comprise a copper dopant in the range of about 8% to about 15% (e.g., about 8%, about 9%, about 10%, about 11%, about 12%, about 13%, about 14%, about 15%) by weight of the doped magnesium alloy, encompassing any value and subset therebetween; the doped aluminum alloy may comprise a mercury dopant in the range of about 0.2% to about 4% (e.g., about 0.2%, about 0.5%, about 1%, about 2%, about 3%, about 4%) by weight of the doped aluminum alloy, encompassing any value and subset therebetween; the doped aluminum alloy may comprise a nickel dopant in the range of about 1% to about % (e.g., about 1%, about 2%, about 3%, about 4%, about 5%, about 6%, about 7%) by weight of the doped aluminum alloy, encompassing any value and subset therebetween; the doped aluminum alloy may comprise a gallium dopant in the range of about 0.2% to about 4% (e.g., about 0.2%, about 0.5%, about 1%, about 2%, about 3%, about 4%) by weight of the doped aluminum alloy, encompassing any value and subset therebetween; and/or the doped aluminum alloy may comprise an iron dopant in the range of about 2% to about 7% (e.g., about 2%, about 3%, about 4%, about 5%, about 6%, about 7%) by weight of the doped aluminum alloy, encompassing any value and subset therebetween. As described above, each of these values is critical to the embodiments of the present disclosure to at least affect the degradation rate of the doped aluminum alloy.

Examples of specific doped aluminum alloys for use in the embodiments of the present disclosure may include, but are not limited to, a doped silumin aluminum alloy (also referred to simply as "a doped silumin alloy"), a doped Al—Mg aluminum alloy, a doped Al—Mg—Mn aluminum alloy, a doped Al—Cu aluminum alloy, a doped Al—Cu—Mg aluminum alloy, a doped Al—Cu—Mn—Si aluminum alloy, a doped Al—Cu—Mn—Mg aluminum alloy, a doped Al—Cu—Mg—Si—Mn aluminum alloy, a doped Al—Zn aluminum alloy, a doped Al—Cu—Zn aluminum alloy, and any combination thereof. As defined herein, a "doped silumin aluminum alloy" is an alloy comprising at least silicon, aluminum, dopant, and optional supplemental material, as defined herein; a "doped Al—Mg aluminum alloy" is at alloy comprising at least magnesium, aluminum, dopant, and optional supplemental material, as defined herein; a "doped Al—Mg—Mn aluminum alloy" is an alloy comprising at least magnesium, manganese, aluminum, dopant, and optional supplemental material, as defined herein; a "doped Al—Cu aluminum alloy" is an alloy comprising at least copper, aluminum, dopant, and optional supplemental material, as defined herein; a "doped Al—Cu—Mg aluminum alloy" is an alloy comprising at least copper, magnesium, aluminum, dopant, and optional supplemental material, as defined herein; a "doped Al—Cu—Mn—Si aluminum alloy" is an alloy comprising at least copper, manganese, silicon, aluminum, dopant, and optional supplemental material, as defined herein; a "doped Al—Cu—Mn—Mg aluminum alloy" is an alloy comprising at least copper, manganese, magnesium, aluminum, dopant, and optional supplemental material, as defined herein; a "doped Al—Cu—Mg—Si—Mn aluminum alloy" is an alloy comprising at least copper, magnesium, silicon, manganese, aluminum, dopant, and optional supplemental material, as defined herein; a "doped Al—Zn aluminum alloy" is an alloy comprising at least zinc, aluminum, dopant, and optional supplemental material, as defined herein; and a "doped Al—Cu—Zn aluminum alloy" is an alloy comprising at least copper, zinc, aluminum, dopant, and optional supplemental material, as defined herein.

Accordingly, any or all of the doped silumin aluminum alloy, the doped Al—Mg aluminum alloy, the doped Al—Mg—Mn aluminum alloy, the doped Al—Cu aluminum alloy, the doped Al—Cu—Mg aluminum alloy, the doped Al—Cu—Mn—Si aluminum alloy, the doped Al—Cu—Mn—Mg aluminum alloy, the doped Al—Cu—Mg—Si—Mn aluminum alloy, the doped Al—Zn aluminum alloy, and/or the doped Al—Cu—Zn aluminum alloy, may comprise a supplemental material, or may have no supplemental material, without departing from the scope of the present disclosure. The specific doped aluminum alloys are discussed in greater detail below.

As will be discussed in greater detail with reference to an exemplary downhole tool 100 in FIG. 2, one or more components of the downhole tool 100 may be made of one type of doped alloy or different types of doped alloys. For example, some components may be made of a doped alloy having a delayed degradation rate compared to another component made of a different doped alloy to ensure that certain portions of the downhole tool 100 degrade prior to other portions.

The doped alloys described herein exhibit a greater degradation rate compared to non-doped alloys owing to their specific composition, the presence of the dopant, the presence of granular inclusions, and the like, or both. The dopant enhances degradation, or accelerates degradation, of the doped alloys by creating a variation in electrochemical voltage within the alloy, which may be grain-to-grain, granular inclusions, and the like. Such variation results in formation of a micro-galvanic circuit within the doped alloy which drives degradation thereof. For example, the zinc concentration of a doped ZK magnesium alloy may vary from grain-to-grain within the alloy, which produces a granular variation in the galvanic potential. As another example, the dopant in a doped AZ magnesium alloy may lead to the formation of granular inclusions where the granular inclusions have a slightly different galvanic potential than the grains in the alloy. These variations in the galvanic potential may result in increased corrosion, as discussed in greater detail below and depicted in FIGS. 3 and 4.

Moreover, the behavior of the doped alloys described herein is different in fresh water, as defined herein, than in higher salinity water often used as an electrolyte to initiate or accelerate degradation thereof. For example, an aluminum alloy doped with 1.4% iron degrades differently in fresh water than in water having a salinity of greater than that or fresh water (e.g., brackish water). The iron dopant segregates toward grain boundaries due to the vacancy migration directed to those boundaries, and forms $Al_3Fe$ phases. In fresh water, the iron present in the $Al_3Fe$ phase dissolves, forming ions that sediment as pure iron in pitting cavities. This pure iron facilitates the cathode reaction of the galvanic corrosion reaction. Iron ions outside the pitting cavities are oxidized to ferrous hydroxide and then to ferric hydroxide. Differently, in higher salinity water (compared to fresh water, as defined herein), the iron remains in the $Al_3Fe$ phase and the cathode reaction is the reduction of oxygen on the $Al_3Fe$ particles.

Referring again to the doped magnesium alloys of the present disclosure, the magnesium concentrations in each of the doped magnesium alloys described herein may vary depending on the desired properties of the alloy. Moreover, the type of doped magnesium alloy (e.g., MG, WE, AZ, ZK, and AM) influences the desired amount of magnesium. Additionally, the amount of magnesium, as well as other metals, dopants, and/or other materials may affect the tensile strength, yield strength, elongation, thermal properties, fabrication characteristics, corrosion properties, densities, and the like.

The doped MG magnesium alloys of the present disclosure comprise magnesium in an amount in the range of from about 75% to about 99.95% by weight of the doped MG magnesium alloy, encompassing any value and subset therebetween. Additionally, the doped MG magnesium alloy comprises a dopant in the amount in the range of from about 0.05% to about 15% by weight of the doped MG magnesium alloy, encompassing any value and subset therebetween. Finally, the doped MG magnesium alloys of the present disclosure may comprise supplementary material, as defined above and discussed below, in an amount in the range of from about 0% to about 10% by weight of the doped MG magnesium alloy, encompassing any value and subset therebetween. That is, in some instances, the doped MG magnesium alloy comprises no supplemental material.

A specific example of a doped MG magnesium alloy for use in forming at least one component of a downhole tool according to the embodiments described herein comprises 75% to 99.95% of magnesium by weight of the doped MG magnesium alloy, 0.05% to 15% dopant by weight of the doped MG magnesium alloy, and 0% to 10% of supplemental material by weight of the doped MG magnesium alloy. In an example, the doped MG magnesium alloy for use in forming at least one component of a downhole tool according to the embodiments described herein comprises 80% to 99% of magnesium by weight of the doped MG magnesium alloy, 1% to 10% dopant by weight of the doped MG magnesium alloy, and 0% to 10% of supplemental material by weight of the doped MG magnesium alloy.

As another specific example, the doped MG magnesium alloys described herein comprises 84% to 99.9% of magnesium by weight of the doped MG magnesium alloy, 0.1% to 6% of a nickel dopant by weight of the doped MG magnesium alloy, and 0% to 10% of supplemental material by weight of the doped MG magnesium alloy. In another embodiment, the doped MG magnesium alloys described herein comprises 78% to 94% of magnesium by weight of the doped MG magnesium alloy, 6% to 12% of a copper dopant by weight of the doped MG magnesium alloy, and 0% to 10% of supplemental material by weight of the doped MG magnesium alloy. In another example, the doped MG magnesium alloys described herein comprises 84% to 99.9% of magnesium by weight of the doped MG magnesium alloy, 0.1% to 6% of a nickel dopant by weight of the doped MG magnesium alloy, and 0% to 10% of supplemental material by weight of the doped MG magnesium alloy. In certain embodiments, the doped MG magnesium alloys described herein comprises 84% to 98% of magnesium by weight of the doped MG magnesium alloy, 2% to 6% of an iron dopant by weight of the doped MG magnesium alloy, and 0% to 10% of supplemental material by weight of the doped MG magnesium alloy.

In other embodiments, a combination of a nickel dopant in the range of 0.1% to 6%, and/or a copper dopant in the range of 6% to 12%, and/or an iron dopant in the range of about 2% to about 6% may be used in forming the doped MG magnesium alloy described herein.

The doped WE magnesium alloys of the present disclosure may comprise magnesium in an amount in the range of from about 60% to about 98.95% by weight of the doped WE magnesium alloy, encompassing any value and subset therebetween. The doped WE magnesium alloy may further comprise a rare earth metal in an amount in the range of from about 1% to about 15% by weight of the doped WE magnesium alloy, encompassing any value and subset therebetween. The rare earth metal may be selected from the group consisting of scandium, lanthanum, cerium, praseodymium, neodymium, promethium, samarium, europium, gadolinium, dysprosium, holmium, erbium, thulium, ytterbium, lutetium, yttrium, and any combination thereof. In preferred embodiments, the rare earth metal comprises yttrium. Additionally, the doped WE magnesium alloy may comprise a dopant in the amount in the range of from about 0.05% to about 15% by weight of the doped WE magnesium alloy, encompassing any value and subset therebetween. Finally, the doped WE magnesium alloys of the present disclosure may comprise supplementary material, as defined above and discussed below, in an amount in the range of from about 0% to about 10% by weight of the doped WE magnesium alloy, encompassing any value and subset therebetween. That is, in some instances, the doped WE magnesium alloy comprises no supplemental material.

A specific example of a doped WE magnesium alloy for use forming at least one component of a downhole tool according to the embodiments described herein comprises 60% to 98.95% of magnesium by weight of the doped WE magnesium alloy, 1% to 15% of a rare earth metal by weight of the doped WE magnesium alloy, 0.05% to 15% dopant by weight of the doped WE magnesium alloy, and 0% to 10% of supplemental material by weight of the doped WE magnesium alloy. In one example, the doped WE magnesium alloy for use forming at least one component of a downhole tool according to the embodiments described herein comprises 65% to 98% of magnesium by weight of the doped WE magnesium alloy, 1% to 15% of a rare earth metal by weight of the doped WE magnesium alloy, 1% to 10% dopant by weight of the doped WE magnesium alloy, and 0% to 10% of supplemental material by weight of the doped WE magnesium alloy.

As another specific example, the doped WE magnesium alloy comprises 69% to 98.9% of magnesium by weight of the doped WE magnesium alloy, 1% to 15% of a rare earth metal by weight of the doped WE magnesium alloy, 0.1% to 6% of a nickel dopant by weight of the doped WE magnesium alloy, and 0% to 10% of supplemental material by weight of the doped WE magnesium alloy. In another example, the doped WE magnesium alloy comprises 63% to 93% of magnesium by weight of the doped WE magnesium alloy, 1% to 15% of a rare earth metal by weight of the doped WE magnesium alloy, 6% to 12% of a copper dopant by weight of the doped WE magnesium alloy, and 0% to 10% of supplemental material by weight of the doped WE magnesium alloy. In some embodiments, the doped WE magnesium alloy comprises 69% to 97% of magnesium by weight of the doped WE magnesium alloy, 1% to 15% of a rare earth metal by weight of the doped WE magnesium alloy, 2% to 6% of an iron dopant by weight of the doped WE magnesium alloy, and 0% to 10% of supplemental material by weight of the doped WE magnesium alloy.

In other embodiments, a combination of a nickel dopant in the range of 0.1% to 6%, and/or a copper dopant in the range of 6% to 12%, and/or an iron dopant in the range of about 2% to about 6% may be used in forming the doped WE magnesium alloy described herein.

The doped AZ magnesium alloys of the present disclosure may comprise magnesium in an amount in the range of from about 57.3% to 98.85% of magnesium by weight of the doped AZ magnesium alloy, encompassing any value and subset therebetween. The doped AZ magnesium alloy may further comprise aluminum in an amount in the range of from about 1% to about 12.7% by weight of the doped AZ magnesium alloy, encompassing any value and subset therebetween. The doped AZ magnesium alloy may further comprise zinc in an amount in the range of from about 0.1% to about 5% by weight of the doped AZ magnesium alloy, encompassing any value and subset therebetween. Additionally, the doped AZ magnesium alloy may comprise a dopant in the amount in the range of from about 0.05% to about 15% by weight of the doped WE magnesium alloy, encompassing any value and subset therebetween. Finally, the doped AZ magnesium alloys of the present disclosure may comprise supplementary material, as defined above and discussed below, in an amount in the range of from about 0% to about 10% by weight of the doped AZ magnesium alloy, encompassing any value and subset therebetween. That is, in some instances, the doped AZ magnesium alloy comprises no supplemental material.

A specific example of a doped AZ magnesium alloy for use forming at least one component of a downhole tool according to the embodiments described herein comprises 57.3% to 98.85% of magnesium by weight of the doped AZ magnesium alloy, 1% to 12.7% aluminum by weight of the doped AZ magnesium alloy, 0.1% to 5% of zinc by weight of the doped AZ magnesium alloy, 0.05% to 15% dopant by weight of the doped AZ magnesium alloy, and 0% to 10% of supplemental material by weight of the doped AZ magnesium alloy. In one example, the doped AZ magnesium alloy for use forming at least one component of a downhole tool according to the embodiments described herein comprises 62.3% to 97.9% of magnesium by weight of the doped AZ magnesium alloy, 1% to 12.7% aluminum by weight of the doped AZ magnesium alloy, 0.1% to 5% of zinc by weight of the doped AZ magnesium alloy, 1% to 10% dopant by weight of the doped AZ magnesium alloy, and 0% to 10% of supplemental material by weight of the doped AZ magnesium alloy.

As another specific example, the doped AZ magnesium alloy comprises 66.3% to 98.8% of magnesium by weight of the doped AZ magnesium alloy, 1% to 12.7% aluminum by weight of the doped AZ magnesium alloy, 0.1% to 5% of zinc by weight of the doped AZ magnesium alloy, 0.1% to 6% of a nickel dopant by weight of the doped AZ magnesium alloy, and 0% to 10% of supplemental material by weight of the doped AZ magnesium alloy. In certain embodiments, the doped AZ magnesium alloy comprises 60.3% to 92.9% of magnesium by weight of the doped AZ magnesium alloy, 1% to 12.7% aluminum by weight of the doped AZ magnesium alloy, 0.1% to 5% of zinc by weight of the doped AZ magnesium alloy, 6% to 12% of a copper dopant by weight of the doped AZ magnesium alloy, and 0% to 10% of supplemental material by weight of the doped AZ magnesium alloy. In another specific example, the doped AZ magnesium alloy comprises 66.3% to 96.9% of magnesium by weight of the doped AZ magnesium alloy, 1% to 12.7% aluminum by weight of the doped AZ magnesium alloy, 0.1% to 5% of zinc by weight of the doped AZ magnesium alloy, 2% to 6% of an iron dopant by weight of the doped AZ magnesium alloy, and 0% to 10% of supplemental material by weight of the doped AZ magnesium alloy.

In other embodiments, a combination of a nickel dopant in the range of 0.1% to 6%, and/or a copper dopant in the range of 6% to 12%, and/or an iron dopant in the range of about 2% to about 6% may be used in forming the doped AZ magnesium alloy described herein.

The doped ZK magnesium alloys of the present disclosure may comprise magnesium in an amount in the range of from about 58% to about 98.94% by weight of the doped ZK magnesium alloy, encompassing any value and subset therebetween. The doped ZK magnesium alloy may further comprise zinc in an amount in the range of from about 1% to about 12% by weight of the doped ZK magnesium alloy, encompassing any value and subset therebetween. The doped ZK magnesium alloy may further comprise zirconium in an amount in the range of from about 0.01% to about 5% by weight of the doped ZK magnesium alloy, encompassing any value and subset therebetween. Additionally, the doped ZK magnesium alloy may comprise a dopant in the amount in the range of from about 0.05% to about 15% by weight of the doped ZK magnesium alloy, encompassing any value and subset therebetween. Finally, the doped ZK magnesium alloys of the present disclosure may comprise supplementary material, as defined above and discussed below, in an amount in the range of from about 0% to about 10% by weight of the doped ZK magnesium alloy, encompassing any value and subset therebetween. That is, in some instances, the doped ZK magnesium alloy comprises no supplemental material.

A specific example of a doped ZK magnesium alloy for use forming at least one component of a downhole tool according to the embodiments described herein comprises 58% to 98.94% of magnesium by weight of the doped ZK magnesium alloy, 1% to 12% of zinc by weight of the doped ZK magnesium alloy, 0.01% to 5% of zirconium by weight of the doped ZK magnesium alloy, 0.05% to 15% dopant by weight of the doped ZK magnesium alloy, and 0% to 10% of supplemental material by weight of the doped ZK magnesium alloy. In one embodiment, the doped ZK magnesium alloy for use forming at least one component of a downhole tool according to the embodiments described herein comprises 63% to 97.99% of magnesium by weight of the doped ZK magnesium alloy, 1% to 12% of zinc by weight of the doped ZK magnesium alloy, 0.01% to 5% of zirconium by weight of the doped ZK magnesium alloy, 1% to 10% dopant by weight of the doped ZK magnesium alloy, and 0% to 10% of supplemental material by weight of the doped ZK magnesium alloy.

In other examples, the doped ZK magnesium alloy comprises 67% to 98.89% of magnesium by weight of the doped ZK magnesium alloy, 1% to 12% of zinc by weight of the doped ZK magnesium alloy, 0.01% to 5% of zirconium by weight of the doped ZK magnesium alloy, 0.1% to 6% of a nickel dopant by weight of the doped ZK magnesium alloy, and 0% to 10% of supplemental material by weight of the doped ZK magnesium alloy. In yet other embodiments, the doped ZK magnesium alloy comprises 61% to 92.9% of magnesium by weight of the doped ZK magnesium alloy, 1% to 12% of zinc by weight of the doped ZK magnesium alloy, 0.01% to 5% of zirconium by weight of the doped ZK magnesium alloy, 6% to 12% of a copper dopant by weight of the doped ZK magnesium alloy, and 0% to 10% of supplemental material by weight of the doped ZK magnesium alloy. In still other embodiments, the doped ZK magnesium alloy comprises 67% to 96.9% of magnesium by weight of the doped ZK magnesium alloy, 1% to 12% of zinc by weight of the doped ZK magnesium alloy, 0.01% to 5% of zirconium by weight of the doped ZK magnesium alloy, 2% to 6% of an iron dopant by weight of the doped ZK magnesium alloy, and 0% to 10% of supplemental material by weight of the doped ZK magnesium alloy.

In other embodiments, a combination of a nickel dopant in the range of 0.1% to 6%, and/or a copper dopant in the range of 6% to 12%, and/or an iron dopant in the range of about 2% to about 6% may be used in forming the doped ZK magnesium alloy described herein.

The doped AM magnesium alloys of the present disclosure may comprise magnesium in an amount in the range of from about 61% to about 97.85% by weight of the doped AM magnesium alloy, encompassing any value and subset therebetween. The doped AM magnesium alloy may further comprise aluminum in an amount in the range of from about 2% to about 10% by weight of the doped AM magnesium alloy, encompassing any value and subset therebetween. The doped AM magnesium alloy may further comprise manganese in an amount in the range of from about 0.1% to about 4% by weight of the doped AM magnesium alloy, encompassing any value and subset therebetween. Additionally, the doped AM magnesium alloy may comprise a dopant in the amount in the range of from about 0.05% to about 15% by weight of the doped AM magnesium alloy, encompassing any value and subset therebetween. Finally, the doped AM magnesium alloys of the present disclosure may comprise supplementary material, as defined above and discussed below, in an amount in the range of from about 0% to about 10% by weight of the doped AM magnesium alloy, encompassing any value and subset therebetween. That is, in some instances, the doped AM magnesium alloy comprises no supplemental material.

In some embodiments, the doped AM magnesium alloy comprises 61% to 97.85% of magnesium by weight of the doped AM magnesium alloy, 2% to 10% of aluminum by weight of the doped magnesium alloy, 0.1% to 4% of manganese by weight of the doped AM magnesium alloy, 0.05% to 15% of dopant by weight of the doped AM magnesium alloy, and 0% to 10% of supplemental material by weight of the doped AM magnesium alloy. In one embodiment, the doped AM magnesium alloy comprises 66% to 96.9% of magnesium by weight of the doped AM magnesium alloy, 2% to 10% of aluminum by weight of the doped magnesium alloy, 0.1% to 4% of manganese by weight of the doped AM magnesium alloy, 1% to 10% of dopant by weight of the doped AM magnesium alloy, and 0% to 10% of supplemental material by weight of the doped AM magnesium alloy.

In certain embodiments, the doped AM magnesium alloy comprises 70% to 97.8% of magnesium by weight of the doped AM magnesium alloy, 2% to 10% of aluminum by weight of the doped magnesium alloy, 0.1% to 4% of manganese by weight of the doped AM magnesium alloy, 0.1% to 6% of a nickel dopant by weight of the doped AM magnesium alloy, and 0% to 10% of supplemental material by weight of the doped AM magnesium alloy. In another example, the doped AM magnesium alloy comprises 70% to 95.9% of magnesium by weight of the doped AM magnesium alloy, 2% to 10% of aluminum by weight of the doped magnesium alloy, 0.1% to 4% of manganese by weight of the doped AM magnesium alloy, 6% to 12% of a copper dopant by weight of the doped AM magnesium alloy, and 0% to 10% of supplemental material by weight of the doped AM magnesium alloy. In still other embodiments, the doped AM magnesium alloy comprises 70% to 95.9% of magnesium by weight of the doped AM magnesium alloy, 2% to 10% of aluminum by weight of the doped magnesium alloy, 0.1% to 4% of manganese by weight of the doped AM magnesium alloy, 2% to 6% of an iron dopant by weight of the doped AM magnesium alloy, and 0% to 10% of supplemental material by weight of the doped AM magnesium alloy.

In other embodiments, a combination of a nickel dopant in the range of 2% to 6%, and/or a copper dopant in the range of 0.1% to 12%, and/or an iron dopant in the range of about 2% to about 6% may be used in forming the doped AM magnesium alloy described herein.

Referring now to the doped aluminum alloys of the present disclosure, the aluminum concentrations in each of the doped aluminum alloys described herein may vary depending on the desired properties of the alloy. Moreover, the type of doped aluminum alloy (e.g., silumin, Al—Mg, Al—Mg—Mn, Al—Cu, Al—Cu—Mg, Al—Cu—Mn—Si, Al—Cu—Mn—Mg, Al—Cu—Mg—Si—Mn, Al—Zn, and Al—Cu—Zn) influence the desired amount of aluminum. Additionally, the amount of aluminum, as well as other metals, dopants, and/or other materials may affect the tensile strength, yield strength, elongation, thermal properties, fabrication characteristics, corrosion properties, densities, and the like.

The doped silumin aluminum alloys of the present disclosure may comprise aluminum in an amount in the range of about 62% to about 96.95% by weight of the doped silumin aluminum alloy, encompassing any value and subset therebetween. The doped silumin aluminum alloy may further comprise silicon in an amount in the range of about 3% to about 13% by weight of the doped silumin aluminum alloy, encompassing any value and subset therebetween. Additionally, the doped silumin aluminum alloy may comprise a dopant in the amount in the range of from about 0.05% to about 15% by weight of the doped silumin aluminum, encompassing any value and subset therebetween. Finally, the doped silumin aluminum alloys of the present disclosure may comprise supplementary material, as defined above and discussed below, in an amount in the range of from about 0% to about 10% by weight of the doped silumin aluminum alloy, encompassing any value and subset therebetween. That is, in some instances, the doped silumin aluminum alloy comprises no supplemental material.

In some embodiments, the doped silumin aluminum alloy comprises 62% to 96.95% of aluminum by weight of the doped silumin aluminum alloy, 3% to 13% of silicon by weight of the doped silumin aluminum alloy, 0.05% to 15% of dopant by weight of the doped silumin aluminum alloy, and 0% to 10% of supplemental material by weight of the doped silumin aluminum alloy. In other embodiments, the doped silumin aluminum alloy comprises 67% to 96% of aluminum by weight of the doped silumin aluminum alloy, 3% to 13% of silicon by weight of the doped silumin aluminum alloy, 1% to 10% of dopant by weight of the doped silumin aluminum alloy, and 0% to 10% of supplemental material by weight of the doped silumin aluminum alloy.

In another embodiment, the doped silumin aluminum alloy comprises 62% to 89% of aluminum by weight of the doped silumin aluminum alloy, 3% to 13% of silicon by weight of the doped silumin aluminum alloy, 8% to 15% of a copper dopant by weight of the doped silumin aluminum alloy, and 0% to 10% of supplemental material by weight of the doped silumin aluminum alloy. In still another embodiment, the doped silumin aluminum alloy comprises 73% to 96.8% of aluminum by weight of the doped silumin aluminum alloy, 3% to 13% of silicon by weight of the doped silumin aluminum alloy, 0.2% to 4% of a gallium dopant by weight of the doped silumin aluminum alloy, and 0% to 10% of supplemental material by weight of the doped silumin aluminum alloy. In another example, the doped silumin aluminum alloy comprises 70% to 96% of aluminum by weight of the doped silumin aluminum alloy, 3% to 13% of silicon by weight of the doped silumin aluminum alloy, 1% to 7% of a nickel dopant by weight of the doped silumin aluminum alloy, and 0% to 10% of supplemental material by weight of the doped silumin aluminum alloy. In another embodiment, the doped silumin aluminum alloy comprises 70% to 95% of aluminum by weight of the doped silumin aluminum alloy, 3% to 13% of silicon by weight of the doped silumin aluminum alloy, 2% to 7% of an iron dopant by weight of the doped silumin aluminum alloy, and 0% to 10% of supplemental material by weight of the doped silumin aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped silumin aluminum alloy described herein.

The doped Al—Mg aluminum alloys of the present disclosure may comprise aluminum in an amount in the range of about 62% to about 99.45% by weight of the doped Al—Mg aluminum alloy, encompassing any value and subset therebetween. The doped Al—Mg aluminum alloy may further comprise magnesium in an amount in the range of about 0.5% to about 13% by weight of the doped Al—Mg aluminum alloy, encompassing any value and subset therebetween. Additionally, the doped Al—Mg aluminum alloy may comprise a dopant in the amount in the range of from about 0.05% to about 15% by weight of the doped Al—Mg aluminum, encompassing any value and subset therebetween. Finally, the doped Al—Mg aluminum alloys of the present disclosure may comprise supplementary material, as defined above and discussed below, in an amount in the range of from about 0% to about 10% by weight of the doped Al—Mg aluminum alloy, encompassing any value and subset therebetween. That is, in some instances, the doped Al—Mg aluminum alloy comprises no supplemental material.

The doped Al—Mg aluminum alloy comprises, in some embodiments, 62% to 99.45% of aluminum by weight of the doped Al—Mg aluminum alloy, 0.5% to 13% of magnesium by weight of the doped Al—Mg aluminum alloy, 0.05% to 15% of a dopant by weight of the doped Al—Mg aluminum alloy, and 0% to 10% of supplemental material by weight of the doped Al—Mg aluminum alloy. In another instance, the doped Al—Mg aluminum alloy comprises, in some embodiments, 67% to 98.5% of aluminum by weight of the doped Al—Mg aluminum alloy, 0.5% to 13% of magnesium by weight of the doped Al—Mg aluminum alloy, 1% to 10% of a dopant by weight of the doped Al—Mg aluminum alloy, and 0% to 10% of supplemental material by weight of the doped Al—Mg aluminum alloy.

In certain embodiments, the doped Al—Mg aluminum alloy comprises, in some embodiments, 62% to 91.5% of aluminum by weight of the doped Al—Mg aluminum alloy, 0.5% to 13% of magnesium by weight of the doped Al—Mg aluminum alloy, 8% to 15% of a copper dopant by weight of the doped Al—Mg aluminum alloy, and 0% to 10% of supplemental material by weight of the doped Al—Mg aluminum alloy. In yet other embodiments, the doped Al—Mg aluminum alloy comprises, in some embodiments, 73% to 99.3% of aluminum by weight of the doped Al—Mg aluminum alloy, 0.5% to 13% of magnesium by weight of the doped Al—Mg aluminum alloy, 0.2% to 4% of a gallium dopant by weight of the doped Al—Mg aluminum alloy, and 0% to 10% of supplemental material by weight of the doped Al—Mg aluminum alloy. As another example, the doped Al—Mg aluminum alloy comprises, in some embodiments, 70% to 98.5% of aluminum by weight of the doped Al—Mg aluminum alloy, 0.5% to 13% of magnesium by weight of the doped Al—Mg aluminum alloy, 1% to 7% of a nickel dopant by weight of the doped Al—Mg aluminum alloy, and 0% to 10% of supplemental material by weight of the doped Al—Mg aluminum alloy. In still another example, the doped Al—Mg aluminum alloy comprises, in some embodiments, 67% to 98.5% of aluminum by weight of the doped Al—Mg aluminum alloy, 0.5% to 13% of magnesium by weight of the doped Al—Mg aluminum alloy, 2% to 7% of an iron dopant by weight of the doped Al—Mg aluminum alloy, and 0% to 10% of supplemental material by weight of the doped Al—Mg aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Mg aluminum alloy described herein.

The doped Al—Mg—Mn aluminum alloys of the present disclosure may comprise aluminum in an amount in the range of about 67% to about 99.2% by weight of the doped Al—Mg—Mn aluminum alloy, encompassing any value and subset therebetween. The doped Al—Mg—Mn aluminum alloy may further comprise magnesium in an amount in the range of about 0.5% to about 7% by weight of the doped Al—Mg—Mn aluminum alloy, encompassing any value and subset therebetween. Further, the doped Al—Mg—Mn aluminum alloy may comprise manganese in an amount in the range of about 0.25% to about 1% by weight of the doped Al—Mg—Mn aluminum alloy, encompassing any value and subset therebetween. Additionally, the doped Al—Mg—Mn aluminum alloy may comprise a dopant in the amount in the range of from about 0.05% to about 15% by weight of the doped Al—Mg—Mn aluminum, encompassing any value and subset therebetween. Finally, the doped Al—Mg—Mn aluminum alloys of the present disclosure may comprise supplementary material, as defined above and discussed below, in an amount in the range of from about 0% to about 10% by weight of the doped Al—Mg—Mn aluminum alloy, encompassing any value and subset therebetween. That is, in some instances, the doped Al—Mg—Mn aluminum alloy comprises no supplemental material.

In some embodiments, the Al—Mg—Mn aluminum alloy comprises 67% to 99.2% of aluminum by weight of the doped Al—Mg—Mn aluminum alloy, 0.5% to 7% of magnesium by weight of the doped Al—Mg—Mn aluminum alloy, 0.25% to 1% of manganese by weight of the doped Al—Mg—Mn aluminum alloy, 0.05% to 15% of a dopant by weight of the doped Al—Mg—Mn aluminum alloy, and 0% to 10% of a supplemental material by weight of the doped Al—Mg—Mn aluminum alloy. In other embodiments, the Al—Mg—Mn aluminum alloy comprises 72% to 98.25% of aluminum by weight of the doped Al—Mg—Mn aluminum alloy, 0.5% to 7% of magnesium by weight of the doped Al—Mg—Mn aluminum alloy, 0.25% to 1% of manganese by weight of the doped Al—Mg—Mn aluminum alloy, 1% to 10% of a dopant by weight of the doped Al—Mg—Mn aluminum alloy, and 0% to 10% of a supplemental material by weight of the doped Al—Mg—Mn aluminum alloy. As another specific example of the Al—Mg—Mn aluminum alloys of the present disclosure, the Al—Mg—Mn aluminum alloy comprises 67% to 91.25% of aluminum by weight of the doped Al—Mg—Mn aluminum alloy, 0.5% to 7% of magnesium by weight of the doped Al—Mg—Mn aluminum alloy, 0.25% to 1% of manganese by weight of the doped Al—Mg—Mn aluminum alloy, 8% to 15% of a copper dopant by weight of the doped Al—Mg—Mn aluminum alloy, and 0% to 10% of a supplemental material by weight of the doped Al—Mg—Mn aluminum alloy.

In yet another embodiment, the Al—Mg—Mn aluminum alloy comprises 78% to 99.05% of aluminum by weight of the doped Al—Mg—Mn aluminum alloy, 0.5% to 7% of magnesium by weight of the doped Al—Mg—Mn aluminum alloy, 0.25% to 1% of manganese by weight of the doped Al—Mg—Mn aluminum alloy, 0.2% to 4% of a gallium dopant by weight of the doped Al—Mg—Mn aluminum alloy, and 0% to 10% of a supplemental material by weight of the doped Al—Mg—Mn aluminum alloy. In still another embodiment, the Al—Mg—Mn aluminum alloy comprises 75% to 98.25% of aluminum by weight of the doped Al—Mg—Mn aluminum alloy, 0.5% to 7% of magnesium by weight of the doped Al—Mg—Mn aluminum alloy, 0.25% to 1% of manganese by weight of the doped Al—Mg—Mn aluminum alloy, 1% to 7% of a nickel dopant by weight of the doped Al—Mg—Mn aluminum alloy, and 0% to 10% of a supplemental material by weight of the doped Al—Mg—Mn aluminum alloy. As another example, the Al—Mg—Mn aluminum alloy comprises 72% to 98.25% of aluminum by weight of the doped Al—Mg—Mn aluminum alloy, 0.5% to 7% of magnesium by weight of the doped Al—Mg—Mn aluminum alloy, 0.25% to 1% of manganese by weight of the doped Al—Mg—Mn aluminum alloy, 2% to 7% of an iron dopant by weight of the doped Al—Mg—Mn aluminum alloy, and 0% to 10% of a supplemental material by weight of the doped Al—Mg—Mn aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Mg—Mn aluminum alloy described herein.

The doped Al—Cu aluminum alloys of the present disclosure may comprise aluminum in an amount in the range of about 64% to about 99.85% by weight of the doped Al—Cu aluminum alloy, encompassing any value and subset therebetween. The doped Al—Cu aluminum alloys may further comprise copper in an amount in the range of about 0.1% to about 11% by weight of the doped Al—Cu aluminum alloy, encompassing any value and subset therebetween. Additionally, the doped Al—Cu aluminum alloy may comprise a dopant in the amount in the range of from about 0.05% to about 15% by weight of the doped Al—Cu aluminum, encompassing any value and subset therebetween. Finally, the doped Al—Cu aluminum alloys of the present disclosure may comprise supplementary material, as defined above and discussed below, in an amount in the range of from about 0% to about 10% by weight of the doped Al—Cu aluminum alloy, encompassing any value and subset therebetween. That is, in some instances, the doped Al—Cu aluminum alloy comprises no supplemental material.

Accordingly, as an example, the Al—Cu aluminum alloy described herein comprises 96% to 98.9% of aluminum by weight of the doped Al—Cu aluminum alloy, 0.1% to 11% of copper by weight of the doped Al—Cu aluminum alloy, 0.05% to 15% of a dopant by weight of the doped Al—Cu aluminum alloy, and 0% to 10% of a supplemental material by weight of the doped Al—Cu aluminum alloy. In another example, the Al—Cu aluminum alloy described herein comprises 64% to 99.85% of aluminum by weight of the doped Al—Cu aluminum alloy, 0.1% to 11% of copper by weight of the doped Al—Cu aluminum alloy, 1% to 10% of a dopant by weight of the doped Al—Cu aluminum alloy, and 0% to 10% of a supplemental material by weight of the doped Al—Cu aluminum alloy.

As another specific example, the Al—Cu aluminum alloy described herein comprises 64% to 91.9% of aluminum by weight of the doped Al—Cu aluminum alloy, 0.1% to 11% of copper by weight of the doped Al—Cu aluminum alloy, 8% to 15% of a copper dopant by weight of the doped Al—Cu aluminum alloy, and 0% to 10% of a supplemental material by weight of the doped Al—Cu aluminum alloy. It will be appreciated that although the Al—Cu aluminum alloy, and other aluminum alloys discussed herein having copper, have a base alloy composition. Additional copper added thereto acts as a dopant described herein. In certain embodiments, the Al—Cu aluminum alloy described herein comprises 75% to 99.7% of aluminum by weight of the doped Al—Cu aluminum alloy, 0.1% to 11% of copper by weight of the doped Al—Cu aluminum alloy, 0.2% to 4% of a gallium dopant by weight of the doped Al—Cu aluminum alloy, and 0% to 10% of a supplemental material by weight of the doped Al—Cu aluminum alloy. In still other examples, the Al—Cu aluminum alloys described herein comprises 72% to 98.9% of aluminum by weight of the doped Al—Cu aluminum alloy, 0.1% to 11% of copper by weight of the doped Al—Cu aluminum alloy, 1% to 7% of a nickel dopant by weight of the doped Al—Cu aluminum alloy, and 0% to 10% of a supplemental material by weight of the doped Al—Cu aluminum alloy. In yet another example, the Al—Cu aluminum alloys described herein comprises 72% to 97.9% of aluminum by weight of the doped Al—Cu aluminum alloy, 0.1% to 11% of copper by weight of the doped Al—Cu aluminum alloy, 2% to 7% of an iron dopant by weight of the doped Al—Cu aluminum alloy, and 0% to 10% of a supplemental material by weight of the doped Al—Cu aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Cu aluminum alloy described herein.

The doped Al—Cu—Mg aluminum alloys of the present disclosure may comprise aluminum in an amount in the range of about 61% to about 99.6% by weight of the doped Al—Cu aluminum alloy, encompassing any value and subset therebetween. Further, the doped Al—Cu—Mg aluminum alloy may comprise copper in the range of about 0.1% to about 13% by weight of the doped Al—Cu—Mg aluminum alloy, encompassing any value and subset therebetween. Also, the doped Al—Cu—Mg aluminum alloy may comprise magnesium in the range of about 0.25% to about 1% by weight of the doped Al—Cu—Mg aluminum alloy, encompassing any value and subset therebetween. Additionally, the doped Al—Cu—Mg aluminum alloy may comprise a dopant in the amount in the range of from about 0.05% to about 15% by weight of the doped Al—Cu—Mg aluminum alloy, encompassing any value and subset therebetween. Finally, the doped Al—Cu—Mg aluminum alloys of the present disclosure may comprise supplementary material, as defined above and discussed below, in an amount in the range of from about 0% to about 10% by weight of the doped Al—Cu—Mg aluminum alloy, encompassing any value and subset therebetween. That is, in some instances, the doped Al—Cu—Mg aluminum alloy comprises no supplemental material.

As one example, thus, the doped Al—Cu—Mg aluminum alloy comprises 61% to 99.6% of aluminum by weight of the doped Al—Cu—Mg aluminum alloy, 0.1% to 13% of copper by weight of the doped Al—Cu—Mg aluminum alloy, 0.25% to 1% of magnesium by weight of the doped Al—Cu—Mg aluminum alloy, 0.05% to 15% of a dopant by weight of the doped Al—Cu—Mg aluminum alloy, and 0% to 10% of a supplemental material by weight of the doped Al—Cu—Mg aluminum alloy. In another example, the doped Al—Cu—Mg aluminum alloy comprises 66% to 98.65% of aluminum by weight of the doped Al—Cu—Mg aluminum alloy, 0.1% to 13% of copper by weight of the doped Al—Cu—Mg aluminum alloy, 0.25% to 1% of magnesium by weight of the doped Al—Cu—Mg aluminum alloy, 1% to 10% of a dopant by weight of the doped Al—Cu—Mg aluminum alloy, and 0% to 10% of a supplemental material by weight of the doped Al—Cu—Mg aluminum alloy.

In a specific example, the doped Al—Cu—Mg aluminum alloy comprises 61% to 91.65% of aluminum by weight of the doped Al—Cu—Mg aluminum alloy, 0.1% to 13% of copper by weight of the doped Al—Cu—Mg aluminum alloy, 0.25% to 1% of magnesium by weight of the doped Al—Cu—Mg aluminum alloy, 8% to 15% of a copper dopant by weight of the doped Al—Cu—Mg aluminum alloy, and 0% to 10% of a supplemental material by weight of the doped Al—Cu—Mg aluminum alloy. In another embodiment, the doped Al—Cu—Mg aluminum alloy comprises 72% to 99.45% of aluminum by weight of the doped Al—Cu—Mg aluminum alloy, 0.1% to 13% of copper by weight of the doped Al—Cu—Mg aluminum alloy, 0.25% to 1% of magnesium by weight of the doped Al—Cu—Mg aluminum alloy, 0.2% to 4% of a gallium dopant by weight of the doped Al—Cu—Mg aluminum alloy, and 0% to 10% of a supplemental material by weight of the doped Al—Cu—Mg aluminum alloy. As one example, the doped Al—Cu—Mg aluminum alloy comprises 69% to 98.65% of aluminum by weight of the doped Al—Cu—Mg aluminum alloy, 0.1% to 13% of copper by weight of the doped Al—Cu—Mg aluminum alloy, 0.25% to 1% of magnesium by weight of the doped Al—Cu—Mg aluminum alloy, 1% to 7% of a nickel dopant by weight of the doped Al—Cu—Mg aluminum alloy, and 0% to 10% of a supplemental material by weight of the doped Al—Cu—Mg aluminum alloy. In one example, the doped Al—Cu—Mg aluminum alloy comprises 69% to 97.65% of aluminum by weight of the doped Al—Cu—Mg aluminum alloy, 0.1% to 13% of copper by weight of the doped Al—Cu—Mg aluminum alloy, 0.25% to 1% of magnesium by weight of the doped Al—Cu—Mg aluminum alloy, 2% to 7% of an iron dopant by weight of the doped Al—Cu—Mg aluminum alloy, and 0% to 10% of a supplemental material by weight of the doped Al—Cu—Mg aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Cu—Mg aluminum alloy described herein.

The Al—Cu—Mn—Si aluminum alloys of the present disclosure may comprise aluminum in an amount in the range of about 68.25% to about 99.35% by weight of the doped Al—Cu—Mn—Si aluminum alloy, encompassing any value and subset therebetween. Further, the Al—Cu—Mn—Si aluminum alloys may comprise copper in an amount in the range of about 0.1% to about 5% by weight of the doped Al—Cu—Mn—Si aluminum alloy, encompassing any value and subset therebetween. The Al—Cu—Mn—Si aluminum alloys may comprise manganese in an amount in the range of about 0.25% to about 1% by weight of the doped Al—Cu—Mn—Si aluminum alloy, encompassing any value and subset therebetween. Silicon may further be included in the Al—Cu—Mn—Si aluminum alloy in an amount in the range of about 0.25% to about 0.75% by weight of the doped Al—Cu—Mn—Si aluminum alloy, encompassing any value and subset therebetween. Additionally, the doped Al—Cu—Mn—Si aluminum alloy may comprise a dopant in the amount in the range of from about 0.05% to about 15% by weight of the doped Al—Cu—Mn—Si aluminum alloy, encompassing any value and subset therebetween. Finally, the doped Al—Cu—Mn—Si aluminum alloys of the present disclosure may comprise supplementary material, as defined above and discussed below, in an amount in the range of from about 0% to about 10% by weight of the doped Al—Cu—Mn—Si aluminum alloy, encompassing any value and subset therebetween. That is, in some instances, the doped Al—Cu—Mn—Si aluminum alloy comprises no supplemental material.

As one example, the Al—Cu—Mn—Si aluminum alloy comprises 68.25% to 99.35% of aluminum by weight of the doped Al—Cu—Mn—Si aluminum alloy, 0.1% to 5% of copper by weight of the doped Al—Cu—Mn—Si aluminum alloy, 0.25% to 1% of manganese by weight of the doped Al—Cu—Mn—Si aluminum alloy, 0.25% to 0.75% of silicon by weight of the doped Al—Cu—Mn—Si aluminum alloy, 0.05% to 15% of a dopant by weight of the doped Al—Cu—Mn—Si aluminum alloy, and 0% to 10% of a supplemental material by weight of the doped Al—Cu—Mn—Si aluminum alloy. In another example, the Al—Cu—Mn—Si aluminum alloy comprises 73.25% to 98.4% of aluminum by weight of the doped Al—Cu—Mn—Si aluminum alloy, 0.1% to 5% of copper by weight of the doped Al—Cu—Mn—Si aluminum alloy, 0.25% to 1% of manganese by weight of the doped Al—Cu—Mn—Si aluminum alloy, 0.25% to 0.75% of silicon by weight of the doped Al—Cu—Mn—Si aluminum alloy, 1% to 10% of a dopant by weight of the doped Al—Cu—Mn—Si aluminum alloy, and 0% to 10% of a supplemental material by weight of the doped Al—Cu—Mn—Si aluminum alloy.

As one example, the Al—Cu—Mn—Si aluminum alloy comprises 68.25% to 91.4% of aluminum by weight of the doped Al—Cu—Mn—Si aluminum alloy, 0.1% to 5% of copper by weight of the doped Al—Cu—Mn—Si aluminum alloy, 0.25% to 1% of manganese by weight of the doped Al—Cu—Mn—Si aluminum alloy, 0.25% to 0.75% of silicon by weight of the doped Al—Cu—Mn—Si aluminum alloy, 8% to 15% of a copper dopant by weight of the doped Al—Cu—Mn—Si aluminum alloy, and 0% to 10% of a supplemental material by weight of the doped Al—Cu—Mn—Si aluminum alloy. In one embodiment, the Al—Cu—Mn—Si aluminum alloy comprises 79.25% to 99.2% of aluminum by weight of the doped Al—Cu—Mn—Si aluminum alloy, 0.1% to 5% of copper by weight of the doped Al—Cu—Mn—Si aluminum alloy, 0.25% to 1% of manganese by weight of the doped Al—Cu—Mn—Si aluminum alloy, 0.25% to 0.75% of silicon by weight of the doped Al—Cu—Mn—Si aluminum alloy, 0.2% to 4% of a gallium dopant by weight of the doped Al—Cu—Mn—Si aluminum alloy, and 0% to 10% of a supplemental material by weight of the doped Al—Cu—Mn—Si aluminum alloy.

In yet other embodiments, the Al—Cu—Mn—Si aluminum alloy comprises 76.25% to 98.4% of aluminum by weight of the doped Al—Cu—Mn—Si aluminum alloy, 0.1% to 5% of copper by weight of the doped Al—Cu—Mn—Si aluminum alloy, 0.25% to 1% of manganese by weight of the doped Al—Cu—Mn—Si aluminum alloy, 0.25% to 0.75% of silicon by weight of the doped Al—Cu—Mn—Si aluminum alloy, 1% to 7% of a nickel dopant by weight of the doped Al—Cu—Mn—Si aluminum alloy, and 0% to 10% of a supplemental material by weight of the doped Al—Cu—Mn—Si aluminum alloy. As still another example, the Al—Cu—Mn—Si aluminum alloy comprises 76.25% to 97.4% of aluminum by weight of the doped Al—Cu—Mn—Si aluminum alloy, 0.1% to 5% of copper by weight of the doped Al—Cu—Mn—Si aluminum alloy, 0.25% to 1% of manganese by weight of the doped Al—Cu—Mn—Si aluminum alloy, 0.25% to 0.75% of silicon by weight of the doped Al—Cu—Mn—Si aluminum alloy, 2% to 7% of an iron dopant by weight of the doped Al—Cu—Mn—Si aluminum alloy, and 0% to 10% of a supplemental material by weight of the doped Al—Cu—Mn—Si aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Cu—Mn—Si aluminum alloy described herein.

The Al—Cu—Mn—Mg aluminum alloys of the present disclosure may comprise aluminum in an amount in the range of about 70.5% to about 99.35% by weight of the doped Al—Cu—Mn—Mg aluminum alloy, encompassing any value and subset therebetween. Further, the Al—Cu—Mn—Mg aluminum alloys may comprise copper in an amount in the range of about 0.1% to about 3% by weight of the doped Al—Cu—Mn—Mg aluminum alloy, encompassing any value and subset therebetween. The Al—Cu—Mn—Mg aluminum alloys may comprise manganese in an amount in the range of about 0.25% to about 0.75% by weight of the doped Al—Cu—Mn—Mg aluminum alloy, encompassing any value and subset therebetween. Magnesium may further be included in the Al—Cu—Mn—Mg aluminum alloy in an amount in the range of about 0.25% to about 0.75% by weight of the doped Al—Cu—Mn—Mg aluminum alloy, encompassing any value and subset therebetween. Additionally, the doped Al—Cu—Mn—Mg aluminum alloy may comprise a dopant in the amount in the range of from about 0.05% to about 15% by weight of the doped Al—Cu—Mn—Mg aluminum alloy, encompassing any value and subset therebetween. Finally, the doped Al—Cu—Mn—Mg aluminum alloys of the present disclosure may comprise supplementary material, as defined above and discussed below, in an amount in the range of from about 0% to about 10% by weight of the doped Al—Cu—Mn—Mg aluminum alloy, encompassing any value and subset therebetween. That is, in some instances, the doped Al—Cu—Mn—Mg aluminum alloy comprises no supplemental material.

As one example, the Al—Cu—Mn—Mg aluminum alloy comprises 70.5% to 99.35% of aluminum by weight of the doped Al—Cu—Mn—Mg aluminum alloy, 0.1% to 3% of copper by weight of the doped Al—Cu—Mn—Mg aluminum alloy, 0.25% to 0.75% of manganese by weight of the doped Al—Cu—Mn—Mg aluminum alloy, 0.25% to 0.75% of magnesium by weight of the doped Al—Cu—Mn—Mg aluminum alloy, 0.05% to 15% of a dopant by weight of the doped Al—Cu—Mn—Mg aluminum alloy, and 0% to 10% of a supplemental material by weight of the doped Al—Cu—Mn—Mg aluminum alloy. In another example, the Al—Cu—Mn—Mg aluminum alloy comprises 75.5% to 98.4% of aluminum by weight of the doped Al—Cu—Mn—Mg aluminum alloy, 0.1% to 3% of copper by weight of the doped Al—Cu—Mn—Mg aluminum alloy, 0.25% to 0.75% of manganese by weight of the doped Al—Cu—Mn—Mg aluminum alloy, 0.25% to 0.75% of magnesium by weight of the doped Al—Cu—Mn—Mg aluminum alloy, 0.05% to 15% of a dopant by weight of the doped Al—Cu—Mn—Mg aluminum alloy, and 0% to 10% of a supplemental material by weight of the doped Al—Cu—Mn—Mg aluminum alloy.

As one example, the Al—Cu—Mn—Mg aluminum alloy comprises 70.5% to 91.4% of aluminum by weight of the doped Al—Cu—Mn—Mg aluminum alloy, 0.1% to 3% of copper by weight of the doped Al—Cu—Mn—Mg aluminum alloy, 0.25% to 0.75% of manganese by weight of the doped Al—Cu—Mn—Mg aluminum alloy, 0.25% to 0.75% of magnesium by weight of the doped Al—Cu—Mn—Mg aluminum alloy, 8% to 15% of a copper dopant by weight of the doped Al—Cu—Mn—Mg aluminum alloy, and 0% to 10% of a supplemental material by weight of the doped Al—Cu—Mn—Mg aluminum alloy. In yet another embodiment, the Al—Cu—Mn—Mg aluminum alloy comprises 81.5% to 99.2% of aluminum by weight of the doped Al—Cu—Mn—Mg aluminum alloy, 0.1% to 3% of copper by weight of the doped Al—Cu—Mn—Mg aluminum alloy, 0.25% to 0.75% of manganese by weight of the doped Al—Cu—Mn—Mg aluminum alloy, 0.25% to 0.75% of magnesium by weight of the doped Al—Cu—Mn—Mg aluminum alloy, 0.2% to 4% of a gallium dopant by weight of the doped Al—Cu—Mn—Mg aluminum alloy, and 0% to 10% of a supplemental material by weight of the doped Al—Cu—Mn—Mg aluminum alloy.

In one embodiment, the Al—Cu—Mn—Mg aluminum alloy comprises 78.5% to 98.4% of aluminum by weight of the doped Al—Cu—Mn—Mg aluminum alloy, 0.1% to 3% of copper by weight of the doped Al—Cu—Mn—Mg aluminum alloy, 0.25% to 0.75% of manganese by weight of the doped Al—Cu—Mn—Mg aluminum alloy, 0.25% to 0.75% of magnesium by weight of the doped Al—Cu—Mn—Mg aluminum alloy, 1% to 7% of a nickel dopant by weight of the doped Al—Cu—Mn—Mg aluminum alloy, and 0% to 10% of a supplemental material by weight of the doped Al—Cu—Mn—Mg aluminum alloy. As another example, the Al—Cu—Mn—Mg aluminum alloy comprises 78.5% to 97.4% of aluminum by weight of the doped Al—Cu—Mn—Mg aluminum alloy, 0.1% to 3% of copper by weight of the doped Al—Cu—Mn—Mg aluminum alloy, 0.25% to 0.75% of manganese by weight of the doped Al—Cu—Mn—Mg aluminum alloy, 0.25% to 0.75% of magnesium by weight of the doped Al—Cu—Mn—Mg aluminum alloy, 2% to 7% of an iron dopant by weight of the doped Al—Cu—Mn—Mg aluminum alloy, and 0% to 10% of a supplemental material by weight of the doped Al—Cu—Mn—Mg aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Cu—Mn—Mg aluminum alloy described herein.

The doped Al—Cu—Mg—Si—Mn aluminum alloys described herein may comprise aluminum in an amount in the range of about 67.5% to about 99.49% by weight of the doped Al—Cu—Mg—Si—Mn aluminum alloy, encompassing any value and subset therebetween. Further, the doped Al—Cu—Mg—Si—Mn aluminum alloys may comprise copper in an amount in the range of about 0.5% to about 5% by weight of the doped Al—Cu—Mg—Si—Mn aluminum alloy, encompassing any value and subset therebetween. Magnesium may be included in the doped Al—Cu—Mg—Si—Mn aluminum alloy in an amount in the range of about 0.25% to about 2% by weight of the doped Al—Cu—Mg—Si—Mn aluminum alloy, encompassing any value and subset therebetween. The doped Al—Cu—Mg—Si—Mn aluminum alloy may further comprise silicon in an amount in the range of about 0.1% to about 0.4% by weight of the doped Al—Cu—Mg—Si—Mn aluminum alloy, encompassing any value and subset therebetween. Manganese may further be included in the Al—Cu—Mg—Si—Mn aluminum alloy in an amount in the range of about 0.01% to about 0.1% by weight of the doped Al—Cu—Mg—Si—Mn aluminum alloy, encompassing any value and subset therebetween. Additionally, the doped Al—Cu—Mg—Si—Mn aluminum alloy may comprise a dopant in the amount in the range of from about 0.05% to about 15% by weight of the doped Al—Cu—Mg—Si—Mn aluminum alloy, encompassing any value and subset therebetween. Finally, the doped Al—Cu—Mg—Si—Mn aluminum alloys of the present disclosure may comprise supplementary material, as defined above and discussed below, in an amount in the range of from about 0% to about 10% by weight of the doped Al—Cu—Mg—Si—Mn aluminum alloy, encompassing any value and subset therebetween. That is, in some instances, the doped Al—Cu—Mg—Si—Mn aluminum alloy comprises no supplemental material.

Accordingly, in some embodiments, the doped Al—Cu—Mg—Si—Mn aluminum alloy comprises 67.5% to 99.49% of aluminum by weight of the doped Al—Cu—Mg—Si—Mn aluminum alloy, 0.1% to 5% of copper by weight of the doped Al—Cu—Mg—Si—Mn aluminum alloy, 0.25% to 2% of magnesium by weight of the doped Al—Cu—Mg—Si—Mn aluminum alloy, 0.1% to 0.4% of silicon by weight of the doped Al—Cu—Mg—Si—Mn aluminum alloy, 0.01% to 0.1% manganese, 0.05% to 15% of a dopant by weight of the doped Al—Cu—Mg—Si—Mn aluminum alloy, and 0% to 10% of a supplemental material. In other embodiments, the doped Al—Cu—Mg—Si—Mn aluminum alloy comprises 72.5% to 98.54% of aluminum by weight of the doped Al—Cu—Mg—Si—Mn aluminum alloy, 0.1% to 5% of copper by weight of the doped Al—Cu—Mg—Si—Mn aluminum alloy, 0.25% to 2% of magnesium by weight of the doped Al—Cu—Mg—Si—Mn aluminum alloy, 0.1% to 0.4% of silicon by weight of the doped Al—Cu—Mg—Si—Mn aluminum alloy, 0.01% to 0.1% manganese, 1% to 10% of a dopant by weight of the doped Al—Cu—Mg—Si—Mn aluminum alloy, and 0% to 10% of a supplemental material.

As a specific example, the doped Al—Cu—Mg—Si—Mn aluminum alloy comprises 67.5% to 91.54% of aluminum by weight of the doped Al—Cu—Mg—Si—Mn aluminum alloy, 0.1% to 5% of copper by weight of the doped Al—Cu—Mg—Si—Mn aluminum alloy, 0.25% to 2% of magnesium by weight of the doped Al—Cu—Mg—Si—Mn aluminum alloy, 0.1% to 0.4% of silicon by weight of the doped Al—Cu—Mg—Si—Mn aluminum alloy, 0.01% to 0.1% manganese, 8% to 15% of a copper dopant by weight of the doped Al—Cu—Mg—Si—Mn aluminum alloy, and 0% to 10% of a supplemental material. As another specific example, the doped Al—Cu—Mg—Si—Mn aluminum alloy comprises 78.5% to 99.34% of aluminum by weight of the doped Al—Cu—Mg—Si—Mn aluminum alloy, 0.1% to 5% of copper by weight of the doped Al—Cu—Mg—Si—Mn aluminum alloy, 0.25% to 2% of magnesium by weight of the doped Al—Cu—Mg—Si—Mn aluminum alloy, 0.1% to 0.4% of silicon by weight of the doped Al—Cu—Mg—Si—Mn aluminum alloy, 0.01% to 0.1% manganese, 0.2% to 4% of a gallium dopant by weight of the doped Al—Cu—Mg—Si—Mn aluminum alloy, and 0% to 10% of a supplemental material.

In some instances, the doped Al—Cu—Mg—Si—Mn aluminum alloy comprises 75.5% to 98.54% of aluminum by weight of the doped Al—Cu—Mg—Si—Mn aluminum alloy, 0.1% to 5% of copper by weight of the doped Al—Cu—Mg—Si—Mn aluminum alloy, 0.25% to 2% of magnesium by weight of the doped Al—Cu—Mg—Si—Mn aluminum alloy, 0.1% to 0.4% of silicon by weight of the doped Al—Cu—Mg—Si—Mn aluminum alloy, 0.01% to 0.1% manganese, 1% to 7% of a nickel dopant by weight of the doped Al—Cu—Mg—Si—Mn aluminum alloy, and 0% to 10% of a supplemental material. In another embodiment, the doped Al—Cu—Mg—Si—Mn aluminum alloy comprises 75.5% to 97.54% of aluminum by weight of the doped Al—Cu—Mg—Si—Mn aluminum alloy, 0.1% to 5% of copper by weight of the doped Al—Cu—Mg—Si—Mn aluminum alloy, 0.25% to 2% of magnesium by weight of the doped Al—Cu—Mg—Si—Mn aluminum alloy, 0.1% to 0.4% of silicon by weight of the doped Al—Cu—Mg—Si—Mn aluminum alloy, 0.01% to 0.1% manganese, 2% to 7% of an iron dopant by weight of the doped Al—Cu—Mg—Si—Mn aluminum alloy, and 0% to 10% of a supplemental material.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Cu—Mg—Si—Mn aluminum alloy described herein.

The Al—Zn aluminum alloys of the present disclosure may comprise aluminum in an amount in the range of about 45% to about 84.95% by weight of the doped Al—Zn, encompassing any value and subset therebetween. Further, the Al—Zn aluminum alloys comprise zinc in an amount in the range of about 15% to about 30% by weight of the doped Al—Zn, encompassing any value and subset therebetween. Additionally, the doped Al—Zn aluminum alloy may comprise a dopant in the amount in the range of from about 0.05% to about 15% by weight of the doped Al—Zn aluminum alloy, encompassing any value and subset therebetween. Finally, the doped Al—Zn aluminum alloys of the present disclosure may comprise supplementary material, as defined above and discussed below, in an amount in the range of from about 0% to about 10% by weight of the doped Al—Zn aluminum alloy, encompassing any value and subset therebetween. That is, in some instances, the doped Al—Zn aluminum alloy comprises no supplemental material.

Thus, in one example, the Al—Zn aluminum alloy comprises 45% to 84.95% of aluminum by weight of the doped Al—Zn aluminum alloy, 15% to 30% of zinc by weight of the doped Al—Zn aluminum alloy, 0.05% to 15% of a dopant by weight of the doped Al—Zn aluminum alloy, and 0% to 10% of supplemental material by weight of the doped Al—Zn aluminum alloy. In another example, the Al—Zn aluminum alloy comprises 50% to 84% of aluminum by weight of the doped Al—Zn aluminum alloy, 15% to 30% of zinc by weight of the doped Al—Zn aluminum alloy, 1% to 10% of a dopant by weight of the doped Al—Zn aluminum alloy, and 0% to 10% of supplemental material by weight of the doped Al—Zn aluminum alloy.

As a specific example, the Al—Zn aluminum alloy comprises 45% to 77% of aluminum by weight of the doped Al—Zn aluminum alloy, 15% to 30% of zinc by weight of the doped Al—Zn aluminum alloy, 8% to 15% of a copper dopant by weight of the doped Al—Zn aluminum alloy, and 0% to 10% of supplemental material by weight of the doped Al—Zn aluminum alloy. As an example, the Al—Zn aluminum alloy comprises 56% to 84.8% of aluminum by weight of the doped Al—Zn aluminum alloy, 15% to 30% of zinc by weight of the doped Al—Zn aluminum alloy, 0.2% to 4% of a gallium dopant by weight of the doped Al—Zn aluminum alloy, and 0% to 10% of supplemental material by weight of the doped Al—Zn aluminum alloy. In one embodiment, the Al—Zn aluminum alloy comprises 53% to 84% of aluminum by weight of the doped Al—Zn aluminum alloy, 15% to 30% of zinc by weight of the doped Al—Zn aluminum alloy, 1% to 7% of a nickel dopant by weight of the doped Al—Zn aluminum alloy, and 0% to 10% of supplemental material by weight of the doped Al—Zn aluminum alloy. In another embodiment, the Al—Zn aluminum alloy comprises 53% to 83% of aluminum by weight of the doped Al—Zn aluminum alloy, 15% to 30% of zinc by weight of the doped Al—Zn aluminum alloy, 2% to 7% of a dopant by weight of the doped Al—Zn aluminum alloy, and 0% to 10% of supplemental material by weight of the doped Al—Zn aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Zn aluminum alloy described herein.

The doped Al—Cu—Zn aluminum alloy described herein may comprise aluminum in an amount in the range of about 63% to about 99.75% by weight of the doped Al—Cu—Zn aluminum alloy, encompassing any value and subset therebetween. Further, the doped Al—Cu—Zn aluminum alloy may comprise copper in an amount in the range of about 0.1% to about 10% by weight of the doped Al—Cu—Zn aluminum alloy, encompassing any value and subset therebetween. Zinc may be included in the Al—Cu—Zn aluminum alloy in an amount in the range of about 0.1% to about 2% by weight of the doped Al—Cu—Zn aluminum alloy, encompassing any value and subset therebetween. Additionally, the doped Al—Cu—Zn aluminum alloy may comprise a dopant in the amount in the range of from about 0.05% to about 15% by weight of the doped Al—Cu—Zn aluminum alloy, encompassing any value and subset therebetween. Finally, the doped Al—Cu—Zn aluminum alloys of the present disclosure may comprise supplementary material, as defined above and discussed below, in an amount in the range of from about 0% to about 10% by weight of the doped Al—Cu—Zn aluminum alloy, encompassing any value and subset therebetween. That is, in some instances, the doped Al—Cu—Zn aluminum alloy comprises no supplemental material.

As one example, the doped Al—Cu—Zn aluminum alloy comprises 63% to 99.75% of aluminum by weight of the doped Al—Cu—Zn aluminum alloy, 0.1% to 10% of copper by weight of the doped Al—Cu—Zn aluminum alloy, 0.1% to 2% of zinc by weight of the doped Al—Cu—Zn aluminum alloy, 0.05% to 15% of a dopant by weight of the doped Al—Cu—Zn aluminum alloy, and 0% to 10% of supplemental material by weight of the doped Al—Cu—Zn aluminum alloy. As another example, the doped Al—Cu—Zn aluminum alloy comprises 68% to 98.8% of aluminum by weight of the doped Al—Cu—Zn aluminum alloy, 0.1% to 10% of copper by weight of the doped Al—Cu—Zn aluminum alloy, 0.1% to 2% of zinc by weight of the doped Al—Cu—Zn aluminum alloy, 1% to 10% of a dopant by weight of the doped Al—Cu—Zn aluminum alloy, and 0% to 10% of supplemental material by weight of the doped Al—Cu—Zn aluminum alloy.

In one specific example, the doped Al—Cu—Zn aluminum alloy comprises 63% to 91.8% of aluminum by weight of the doped Al—Cu—Zn aluminum alloy, 0.1% to 10% of copper by weight of the doped Al—Cu—Zn aluminum alloy, 0.1% to 2% of zinc by weight of the doped Al—Cu—Zn aluminum alloy, 8% to 15% of a copper dopant by weight of the doped Al—Cu—Zn aluminum alloy, and 0% to 10% of supplemental material by weight of the doped Al—Cu—Zn aluminum alloy. In one embodiment, the doped Al—Cu—Zn aluminum alloy comprises 74% to 99.6% of aluminum by weight of the doped Al—Cu—Zn aluminum alloy, 0.1% to 10% of copper by weight of the doped Al—Cu—Zn aluminum alloy, 0.1% to 2% of zinc by weight of the doped Al—Cu—Zn aluminum alloy, 0.2% to 4% of a gallium dopant by weight of the doped Al—Cu—Zn aluminum alloy, and 0% to 10% of supplemental material by weight of the doped Al—Cu—Zn aluminum alloy. In another embodiment, the doped Al—Cu—Zn aluminum alloy comprises 71% to 98.8% of aluminum by weight of the doped Al—Cu—Zn aluminum alloy, 0.1% to 10% of copper by weight of the doped Al—Cu—Zn aluminum alloy, 0.1% to 2% of zinc by weight of the doped Al—Cu—Zn aluminum alloy, 1% to 7% of a nickel dopant by weight of the doped Al—Cu—Zn aluminum alloy, and 0% to 10% of supplemental material by weight of the doped Al—Cu—Zn aluminum alloy. In yet another example, the doped Al—Cu—Zn aluminum alloy comprises 71% to 97.8% of aluminum by weight of the doped Al—Cu—Zn aluminum alloy, 0.1% to 10% of copper by weight of the doped Al—Cu—Zn aluminum alloy, 0.1% to 2% of zinc by weight of the doped Al—Cu—Zn aluminum alloy, 2% to 7% of a dopant by weight of the doped Al—Cu—Zn aluminum alloy, and 0% to 10% of supplemental material by weight of the doped Al—Cu—Zn aluminum alloy.

In other embodiments, a combination of a copper dopant in the range of 8% to 15%, and/or a gallium dopant in the range of 0.2% to 4%, and/or a nickel dopant in the range of 1% to 7%, and/or an iron dopant in the range of about 2% to about 7% may be used in forming the doped Al—Cu—Zn aluminum alloy described herein.

The various supplemental materials that may be included in the doped alloys described herein, may be natural reaction products or raw material carryover. Examples of such natural supplemental materials may include, but are not limited to, oxides (e.g., magnesium oxide), nitrides (e.g., magnesium nitride), sodium, potassium, hydrogen, and the like, and any combination thereof. In other embodiments, the supplemental materials may be intentionally included in the doped alloys described herein to impart a desired quality. For example, in some embodiments, the intentionally included supplemental materials may include, but are not limited to, a reinforcing agent, a corrosion retarder, a corrosion accelerant, a reinforcing agent (i.e., to increase strength or stiffness, including, but not limited to, a fiber, a particulate, a fiber weave, and the like, and combinations thereof), silicon, calcium, lithium, manganese, tin, lead, thorium, zirconium, beryllium, cerium, praseodymium, yttrium, and the like, and any combination thereof. Although some of these supplementary materials overlap with the primary elements of a particular doped alloy (like some dopants), they are not considered supplementary materials unless they are not a primary element of the doped alloy in which they are included, as described above. These intentionally placed supplemental materials may, among other things, provide enhance the mechanical properties of the doped alloy into which they are included.

Each value for the primary elements of the doped alloys, dopant, and supplemental material described above is critical for use in the embodiments of the present disclosure and may depend on a number of factors including, but not limited to, the type of downhole tool and component(s) formed from the doped alloy, the type and amount of dopant selected, the inclusion and type of supplemental material, the amount of supplemental material, the desired degradation rate, the conditions of the subterranean formation in which the downhole tool is used, and the like.

In some embodiments, the rate of degradation of the doped alloys described herein may be in the range of from about 1% to about 100% of its total mass per about 24 hours in a fresh water solution (e.g., potassium chloride in an aqueous fluid) at about 93° C. (200° F.). In other embodiments, the dissolution rate of the doped alloy may be greater than about 0.01 milligram per square centimeter, such as in the range of about 0.01 $mg/cm^2$ to about 2000 $mg/cm^2$, per about one hour in a fresh water solution (e.g., a halide salt, such as potassium chloride or sodium chloride, in an aqueous fluid) at about 93° C. (200° F.), encompassing any value and subset therebetween.

It will be appreciated by one of skill in the art that the well system 110 of FIG. 1 is merely one example of a wide variety of well systems in which the principles of the present disclosure may be utilized. Accordingly, it will be appreciated that the principles of this disclosure are not necessarily limited to any of the details of the depicted well system 110, or the various components thereof, depicted in the drawings or otherwise described herein. For example, it is not necessary in keeping with the principles of this disclosure for the wellbore 120 to include a generally vertical cased section. The well system 110 may equally be employed in vertical and/or deviated wellbores, without departing from the scope of the present disclosure. Furthermore, it is not necessary for a single downhole tool 100 to be suspended from the tool string 118.

In addition, it is not necessary for the downhole tool 100 to be lowered into the wellbore 120 using the derrick 112. Rather, any other type of device suitable for lowering the downhole tool 100 into the wellbore 120 for placement at a desired location, or use therein to perform a downhole operation may be utilized without departing from the scope of the present disclosure such as, for example, mobile workover rigs, well servicing units, and the like. Although not depicted, the downhole tool 100 may alternatively be hydraulically pumped into the wellbore and, thus, not need the tool string 118 for delivery into the wellbore 120.

Figure 2:
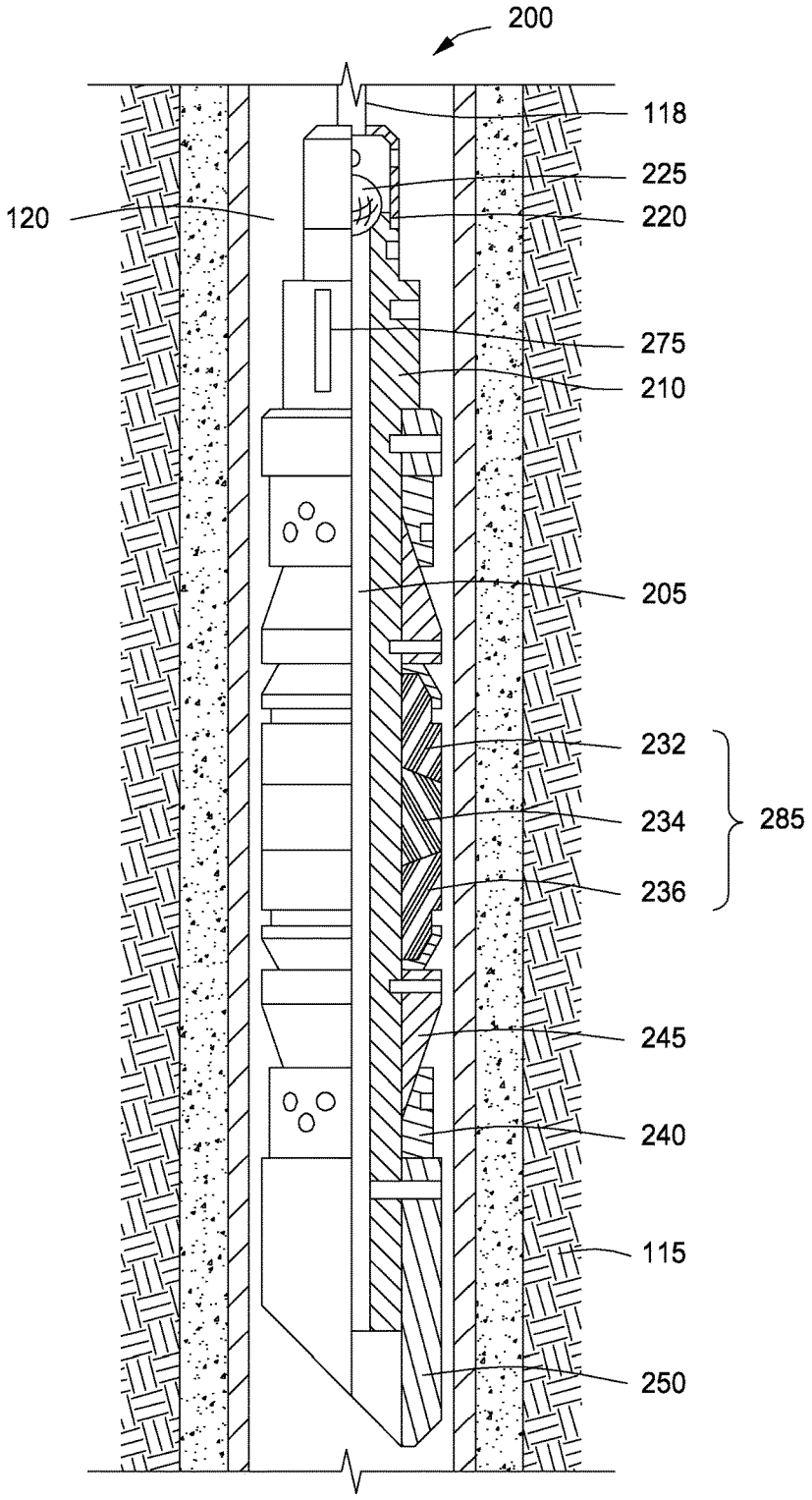
FIG. 2 illustrates a cross-sectional view of an exemplary downhole tool that can employ one or more principles of the present disclosure, according to one or more embodiments.

Referring now to FIG. 2, with continued reference to FIG. 1, one specific type of downhole tool 100 described herein is a frac plug wellbore isolation device for use during a well stimulation/fracturing operation. FIG. 2 illustrates a cross-sectional view of an exemplary frac plug 200 being lowered into a wellbore 120 on a tool string 118. As previously mentioned, the frac plug 200 generally comprises a body 210 and a sealing element 285. The sealing element 285, as depicted, comprises an upper sealing element 232, a center sealing element 234, and a lower sealing element 236. It will be appreciated that although the sealing element 285 is shown as having three portions (i.e., the upper sealing element 232, the center sealing element 234, and the lower sealing element 236), any other number of portions, or a single portion, may also be employed without departing from the scope of the present disclosure.

As depicted, the sealing element 285 is extending around the body 210; however, it may be of any other configuration suitable for allowing the sealing element 285 to form a fluid seal in the wellbore 120, without departing from the scope of the present disclosure. For example, in some embodiments, the body may comprise two sections joined together by the sealing element, such that the two sections of the body compress to permit the sealing element to make a fluid seal in the wellbore 120. Other such configurations are also suitable for use in the embodiments described herein. Moreover, although the sealing element 285 is depicted as located in a center section of the body 210, it will be appreciated that it may be located at any location along the length of the body 210, without departing from the scope of the present disclosure.

The body 210 of the frac plug 200 comprises an axial flowbore 205 extending therethrough. A cage 220 is formed at the upper end of the body 210 for retaining a ball 225 that acts as a one-way check valve. In particular, the ball 225 seals off the flowbore 205 to prevent flow downwardly therethrough, but permits flow upwardly through the flowbore 205. One or more slips 240 are mounted around the body 210 below the sealing element 285. The slips 240 are guided by a mechanical slip body 245. A tapered shoe 250 is provided at the lower end of the body 210 for guiding and protecting the frac plug 200 as it is lowered into the wellbore 120. An optional enclosure 275 for storing a chemical solution may also be mounted on the body 210 or may be formed integrally therein. In one embodiment, the enclosure 275 is formed of a frangible material.

Either or both of the body 210 and the sealing element 285 may be composed at least partially of a doped alloy described herein. Moreover, components of either or both of the body 210 and the sealing element 285 may be composed of one or more of the doped alloys. For example, one or more of the cage 220, the ball 225, the slips 240, the mechanical slip body 245, the tapered shoe 250, or the enclosure 275 may be formed from the same or a different type of doped alloy, without departing from the scope of the present disclosure. Moreover, although components of a downhole tool 100 (FIG. 1) are explained herein with reference to a frac plug 200, other downhole tools and components thereof may be formed from a doped alloy having the compositions described herein without departing from the scope of the present disclosure.

In some embodiments, the doped alloys forming a portion of the downhole tool 100 (FIG. 1) may be at least partially encapsulated in a second material (e.g., a "sheath") formed from an encapsulating material capable of protecting or prolonging degradation of the doped alloy (e.g., delaying contact with an electrolyte). The sheath may also serve to protect the downhole tool 100 from abrasion within the wellbore 120. The structure of the sheath may be permeable, frangible, or of a material that is at least partially removable at a desired rate within the wellbore environment. The encapsulating material forming the sheath may be any material capable of use in a downhole environment and, depending on the structure of the sheath. For example, a frangible sheath may break as the downhole tool 100 is placed at a desired location in the wellbore 120 or as the downhole tool 100 is actuated, if applicable, whereas a permeable sheath may remain in place on the sealing element 285 as it forms the fluid seal. As used herein, the term "permeable" refers to a structure that permits fluids (including liquids and gases) therethrough and is not limited to any particular configuration. Suitable encapsulating materials may include, but are not limited to, a wax, a drying oil, a polyurethane, a crosslinked partially hydrolyzed polyacrylic, a silicate material, a glass material, an inorganic durable material, a polymer, a polylactic acid, a polyvinyl alcohol, a polyvinylidene chloride, an elastomer, a thermoplastic, and any combination thereof.

Referring again to FIG. 1, removing the downhole tool 100, described herein from the wellbore 120 is more cost effective and less time consuming than removing conventional downhole tools, which require making one or more trips into the wellbore 120 with a mill or drill to gradually grind or cut the tool away. Instead, the downhole tools 100 described herein are removable by simply exposing the tools 100 to an introduced electrolyte fluid or a produced (i.e., naturally occurring by the formation) electrolyte fluid in the downhole environment. The foregoing descriptions of specific embodiments of the downhole tool 100, and the systems and methods for removing the biodegradable tool 100 from the wellbore 120 have been presented for purposes of illustration and description and are not intended to be exhaustive or to limit this disclosure to the precise forms disclosed. Many other modifications and variations are possible. In particular, the type of downhole tool 100, or the particular components that make up the downhole tool 100 (e.g., the body and sealing element) may be varied. For example, instead of a frac plug 200 (FIG. 2), the downhole tool 100 may comprise a bridge plug, which is designed to seal the wellbore 120 and isolate the zones above and below the bridge plug, allowing no fluid communication in either direction. Alternatively, the degradable downhole tool 100 could comprise a packer that includes a shiftable valve such that the packer may perform like a bridge plug to isolate two formation zones, or the shiftable valve may be opened to enable fluid communication therethrough. Similarly, the downhole tool 100 could comprise a wiper plug or a cement plug or any other downhole tool having a variety of components.

While various embodiments have been shown and described herein, modifications may be made by one skilled in the art without departing from the scope of the present disclosure. The embodiments described here are exemplary only, and are not intended to be limiting. Many variations, combinations, and modifications of the embodiments disclosed herein are possible and are within the scope of the disclosure. Accordingly, the scope of protection is not limited by the description set out above, but is defined by the claims which follow, that scope including all equivalents of the subject matter of the claims.

Embodiments disclosed herein include Embodiment A, Embodiment B, and Embodiment C:

Embodiment A

A downhole tool comprising: at least one component of the downhole tool made of a doped alloy that at least partially degrades by micro-galvanic corrosion in the presence of fresh water, the fresh water having a salinity of less than about 1000 ppm, wherein the doped alloy is selected from the group consisting of a doped magnesium alloy, a doped aluminum alloy, and any combination thereof.

Embodiment B

A method comprising: introducing a downhole tool into a subterranean formation, the downhole tool comprising at least one component made of a doped alloy selected from the group consisting of doped a magnesium alloy, a doped aluminum alloy, and any combination thereof; performing a downhole operation; and degrading by micro-galvanic corrosion at least a portion of the doped alloy in the subterranean formation by contacting the doped alloy with fresh water having a salinity of less than about 1000 ppm.

Embodiment C

A system comprising: a tool string connected to a derrick and extending through a surface into a wellbore in a subterranean formation; and a downhole tool connected to the tool string and placed in the wellbore, the downhole tool comprising at least one component made of a doped alloy that at least partially degrades by micro-galvanic corrosion in the presence of fresh water, the fresh water having a salinity of less than about 1000 ppm, wherein the doped alloy is selected from the group consisting of a doped magnesium alloy, a doped aluminum alloy, and any combination thereof.

Each of Embodiments A, B, and C may have one or more of the following additional elements in any combination:

Element 1: Wherein the salinity of the fresh water is in the range of about 10 ppm to about 1000 ppm.

Element 2: Wherein the salinity of the fresh water is due to ions selected from the group consisting of chloride, sodium, nitrate, calcium, potassium, magnesium, bicarbonate, sulfate, and any combination thereof.

Element 3: Wherein the doped alloy comprises a dopant in the range of about 0.05% to about 15%.

Element 4: Wherein the doped alloy comprises a dopant in the range of about 1% to about 10%.

Element 5: Wherein the doped alloy comprises a dopant selected from the group consisting of iron, copper, nickel, tin, chromium, cobalt, calcium, lithium, silver, gold, palladium, gallium, mercury, and any combination thereof.

Element 6: Wherein the doped magnesium alloy comprises a nickel dopant in the range of about 2% to about 6%, a copper dopant in the range of about 6% to about 12%, and/or an iron dopant in the range of about 2% to about 6%.

Element 7: Wherein the doped aluminum alloy comprises a copper dopant in the range of about 8% to about 15%, a gallium dopant in the range of about 0.2% to about 4%, a nickel dopant in the range of about 1% to about 7%, and/or an iron dopant in the range of about 2% to about 7%.

Element 8: Wherein the doped magnesium alloy is selected from the group consisting of a doped WE magnesium alloy, a doped AZ magnesium alloy, a doped ZK magnesium alloy, a doped AM magnesium alloy, and any combination thereof.

Element 9: Wherein the doped aluminum alloy is selected from the group consisting of a doped silumin aluminum alloy, a doped Al—Mg aluminum alloy, a doped Al—Mg—Mn aluminum alloy, a doped Al—Cu aluminum alloy, a doped Al—Cu—Mg aluminum alloy, a doped Al—Cu—Mn—Si aluminum alloy, a doped Al—Cu—Mn—Mg aluminum alloy, a doped Al—Cu—Mg—Si—Mn aluminum alloy, a doped Al—Zn aluminum alloy, a doped Al—Cu—Zn aluminum alloy, and any combination thereof.

Element 10: Wherein the doped alloy exhibits a degradation rate of greater than about 0.01 milligram per cubic centimeter per hour at about 93° C.

Element 11: Wherein the downhole tool is selected from the group consisting of a wellbore isolation device, a perforation tool, a cementing tool, a completion tool, and any combination thereof.

Element 12: Wherein the downhole tool is a wellbore isolation device selected from the group consisting of a frac plug, a frac ball, a setting ball, a bridge plug, a wellbore packer, a wiper plug, a cement plug, a basepipe plug, a sand screen plug, an inflow control device (ICD) plug, an autonomous ICD plug, a tubing section, a tubing string, and any combination thereof.

Element 13: Wherein the at least one component is selected from the group consisting of a mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block, a logging tool, a housing, a release mechanism, a pumpdown tool, an inflow control device plug, an autonomous inflow control device plug, a coupling, a connector, a support, an enclosure, a cage, a slip body, a tapered shoe, and any combination thereof.

By way of non-limiting example, exemplary combinations applicable to Embodiments A, B, and/or C include: 1-13; 1, 3, and 10; 11, 12, and 13; 2, 5, 6, and 9; 1 and 8; 2, 4, 7, and 10; 3 and 13; 5, 8, and 9; 2 and 6; 5, 7, and 12; and the like.

To facilitate a better understanding of the embodiments of the present disclosure, the following example is given. In no way should the following example be read to limit, or to define, the scope of the disclosure.

Example

Figure 3:
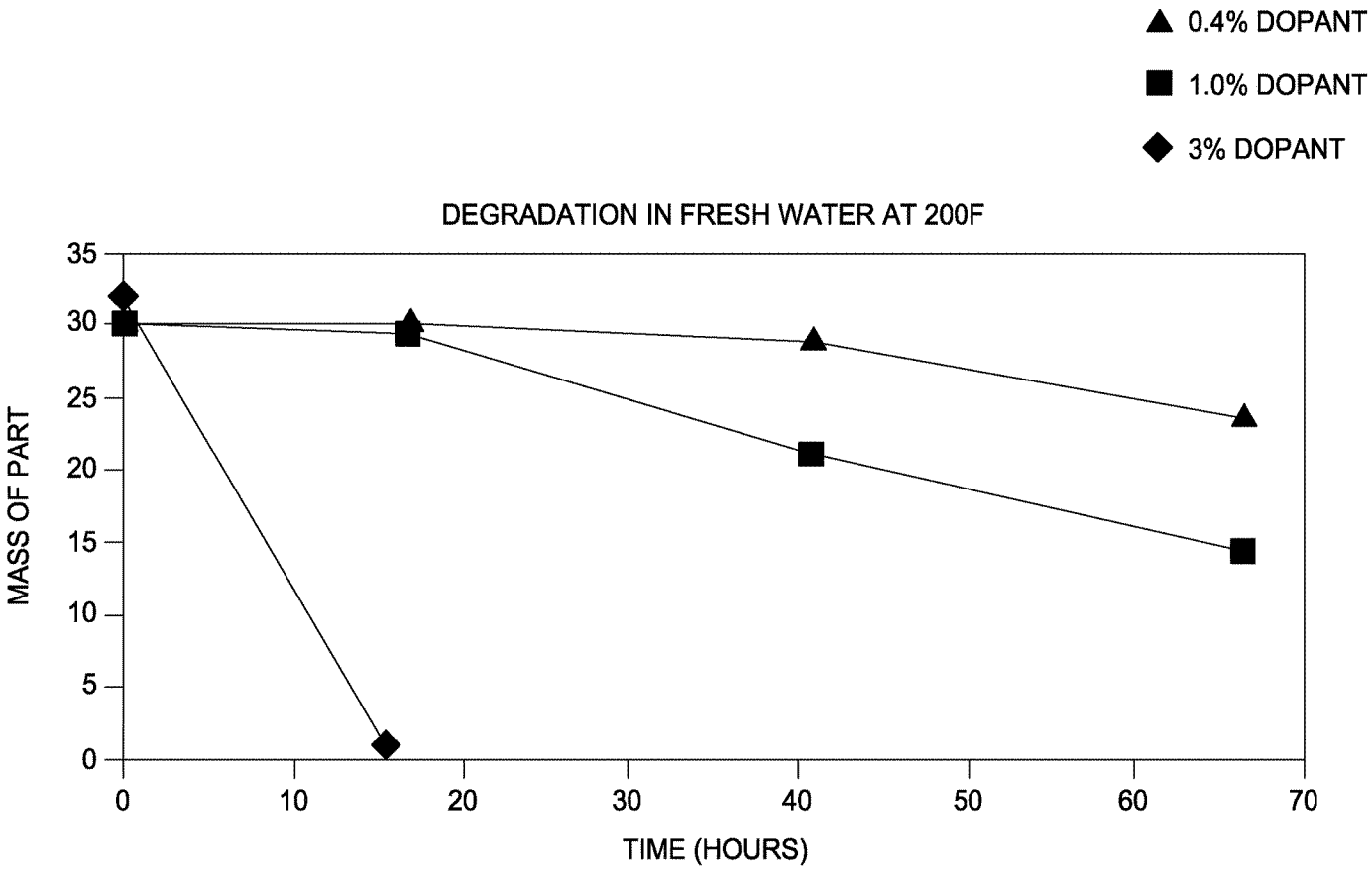
FIG. 3 illustrates the degradation rate of a doped magnesium alloy solid solution, according to one or more embodiments of the present disclosure.

In this example, the degradation rate of a doped magnesium in fresh water was evaluated at 93° C. (200° F.). Three magnesium alloy samples were prepared having 0.4% dopant, 1% dopant, and 3% dopant. The dopant was a mixture of nickel, copper, iron, and silver. Cubes of each magnesium alloy were placed in fresh water, as defined herein, that had a salinity of about 88 ppm (34 ppm sodium, 35 ppm calcium, 5 ppm magnesium, 4 ppm potassium). The fresh water and magnesium alloys were heated to 200° F. and the mass of the magnesium alloys were measured during the degradation process. The mass was measured by removing the alloy cubes from the fresh water, allowing them to air dry and measuring them with an Ohaus brand scale. As shown in FIG. 3, the alloy comprising the 3% dopant had the fastest degradation rate, indicating the importance of including a dopant to control degradation rate.

Figure 4:
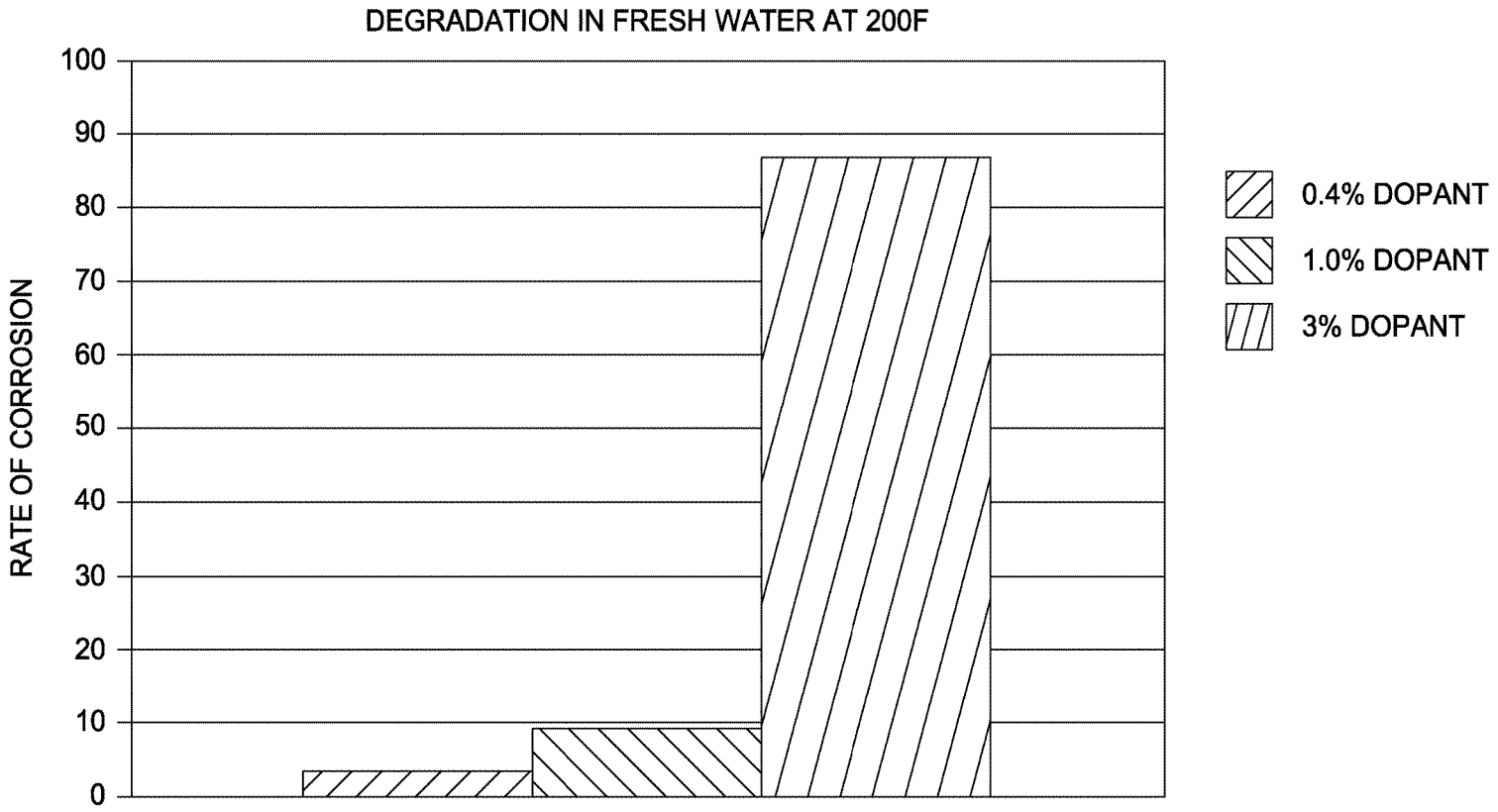
FIG. 4 illustrates the rate of corrosion of a doped magnesium alloy solid solution, according to one or more embodiments of the present disclosure.

Referring now to FIG. 4, illustrated is a graph representing the degradation rate of each of the three doped magnesium alloys. Rate of corrosion was calculated by dividing the change in mass by the average surface area of the alloys and elapsed time. The rate of corrosion is expressed in milligrams per square centimeter per hour ($mg/cm^2/hr$).

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A downhole tool comprising:

at least one component of the downhole tool made of a doped alloy that at least partially degrades by microgalvanic corrosion in the presence of fresh water, the fresh water having a salinity of less than about 1000 ppm, wherein the doped alloy is selected from the group consisting of:

a doped magnesium alloy comprising a dopant selected from the group consisting of a nickel dopant in the range of about 2% to about 6%, a copper dopant in the range of about 6% to about 12%, an iron dopant in the range of about 2% to about 6%, and any combination thereof;

a doped magnesium alloy selected from the group consisting of a doped WE magnesium alloy, a doped AZ magnesium alloy, a doped ZK magnesium alloy, a doped AM magnesium alloy, and any combination thereof; and a doped aluminum alloy comprising greater than about 50% by weight of aluminum and a dopant selected from the group consisting of a copper dopant in the range of about 8% to about 15%, a gallium dopant in the range of about 0.2% to about 4%, a nickel dopant in the range of about 1% to about 7%, an iron dopant in the range of about 2% to about 7%, and any combination thereof.

2. The downhole tool of claim 1, wherein the salinity of the fresh water is in the range of about 10 ppm to about 1000 ppm.

3. The downhole tool of claim 1, wherein the salinity of the fresh water is due to ions selected from the group consisting of chloride, sodium, nitrate, calcium, potassium, magnesium, bicarbonate, sulfate, and any combination thereof.

4. The downhole tool of claim 1, wherein the doped alloy is the magnesium alloy comprising a dopant selected from the group consisting of a nickel dopant in the range of about 2% to about 6%, a copper dopant in the range of about 6% to about 12%, an iron dopant in the range of about 2% to about 6%, and any combination thereof.

5. The downhole tool of claim 1, wherein the doped alloy is the aluminum alloy comprising greater than about 50% by weight of aluminum and a dopant selected from the group consisting of a copper dopant in the range of about 8% to about 15%, a gallium dopant in the range of about 0.2% to about 4%, a nickel dopant in the range of about 1% to about 7%, an iron dopant in the range of about 2% to about 7%, and any combination thereof.

6. The downhole tool of claim 1, wherein the doped alloy is the magnesium alloy selected from the group consisting of a doped WE magnesium alloy, a doped AZ magnesium alloy, a doped ZK magnesium alloy, a doped AM magnesium alloy, and any combination thereof.

7. The downhole tool of claim 1, wherein the doped alloy exhibits a degradation rate of greater than about 0.01 milligram per cubic centimeter per hour at about 93° C.

8. The downhole tool of claim 1, wherein the downhole tool is selected from the group consisting of a wellbore isolation device, a perforation tool, a cementing tool, a completion tool, and any combination thereof.

9. The downhole tool of claim 1, wherein the downhole tool is a wellbore isolation device selected from the group consisting of a frac plug, a frac ball, a setting ball, a bridge plug, a wellbore packer, a wiper plug, a cement plug, a basepipe plug, a sand screen plug, an inflow control device (ICD) plug, an autonomous ICD plug, a tubing section, a tubing string, and any combination thereof.

10. The downhole tool of claim 1, wherein the at least one component is selected from the group consisting of a mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block, a logging tool, a housing, a release mechanism, a pumpdown tool, an inflow control device plug, an autonomous inflow control device plug, a coupling, a connector, a support, an enclosure, a cage, a slip body, a tapered shoe, and any combination thereof.

11. A method comprising: introducing a downhole tool into a subterranean formation, the downhole tool comprising at least one component made of a doped alloy selected from the group consisting of: a doped magnesium alloy comprising a dopant selected from the group consisting of a nickel dopant in the range of about 2% to about 6%, a copper dopant in the range of about 6% to about 12%, an iron dopant in the range of about 2% to about 6%, and any combination thereof, a doped magnesium alloy selected from the group consisting of a doped WE magnesium alloy, a doped AZ magnesium alloy, a doped ZK magnesium alloy, a doped AM magnesium alloy, and any combination thereof, a doped aluminum alloy comprising greater than about 50% by weight of aluminum and a dopant selected from the group consisting of a copper dopant in the range of about 8% to about 15%, a gallium dopant in the range of about 0.2% to about 4%, a nickel dopant in the range of about 1% to about 7%, an iron dopant in the range of about 2% to about 7%, and any combination thereof, performing a downhole operation; and degrading by micro-galvanic corrosion at least a portion of the doped alloy in the subterranean formation by contacting the doped alloy with fresh water having a salinity of less than about 1000 ppm.

12. The method of claim 11, wherein the salinity of the fresh water is in the range of about 10 ppm to about 1000 ppm.

13. A system comprising: a tool string connected to a derrick and extending through a surface into a wellbore in a subterranean formation; and a downhole tool connected to the tool string and placed in the wellbore, the downhole tool comprising at least one component made of a doped alloy that at least partially degrades by micro-galvanic corrosion in the presence of fresh water, the fresh water having a salinity of less than about 1000 ppm, wherein the doped alloy is selected from the group consisting of: a doped magnesium alloy comprising a dopant selected from the group consisting of a nickel dopant in the range of about 2% to about 6%, a copper dopant in the range of about 6% to about 12%, an iron dopant in the range of about 2% to about 6%, and any combination thereof, a doped magnesium alloy selected from the group consisting of a doped WE magnesium alloy, a doped AZ magnesium alloy, a doped ZK magnesium alloy, a doped AM magnesium alloy, and any combination thereof, a doped aluminum alloy comprising greater than about 50% by weight of aluminum and a dopant selected from the group consisting of a copper dopant in the range of about 8% to about 15%, a gallium dopant in the range of about 0.2% to about 4%, a nickel dopant in the range of about 1% to about 7%, an iron dopant in the range of about 2% to about 7%, and any combination thereof.

14. The system of claim 13, wherein the salinity of the fresh water is in the range of about 10 ppm to about 1000 ppm.

* * * * *